US008342668B2

(12) United States Patent
Nakazawa

(10) Patent No.: US 8,342,668 B2
(45) Date of Patent: Jan. 1, 2013

(54) LIQUID APPLICATION APPARATUS, LIQUID STORAGE METHOD AND INKJET RECORDING APPARATUS

(75) Inventor: Yusuke Nakazawa, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 553 days.

(21) Appl. No.: 12/568,352

(22) Filed: Sep. 28, 2009

(65) Prior Publication Data

US 2010/0079516 A1 Apr. 1, 2010

(30) Foreign Application Priority Data

Sep. 29, 2008 (JP) ..... 2008-251422

(51) Int. Cl.
*B41J 2/175* (2006.01)

(52) U.S. Cl. ..... 347/93

(58) Field of Classification Search ..... 347/68–72, 347/93

See application file for complete search history.

(56) References Cited

U.S. PATENT DOCUMENTS

| | | | | |
|---|---|---|---|---|
| 3,714,928 | A * | 2/1973 | Taylor | 118/624 |
| 5,008,688 | A * | 4/1991 | Ebinuma et al. | 347/86 |
| 5,245,360 | A * | 9/1993 | Ebinuma et al. | 347/86 |
| 6,840,280 | B1 * | 1/2005 | Simon | 137/828 |
| 2005/0200666 | A1 * | 9/2005 | Iwasaki et al. | 347/84 |
| 2007/0138914 | A1 * | 6/2007 | Ishikawa et al. | 310/328 |
| 2009/0246396 | A1 * | 10/2009 | Nakazawa et al. | 427/428.18 |
| 2009/0311426 | A1 * | 12/2009 | Nakazawa et al. | 427/256 |

FOREIGN PATENT DOCUMENTS

| | | | |
|---|---|---|---|
| JP | 8-72227 | A | 3/1996 |
| JP | 2000-311864 | * | 11/2000 |
| JP | 2002-517341 | A | 6/2002 |
| JP | 2005-254809 | A | 9/2005 |
| JP | 2006-167556 | A | 6/2006 |
| WO | WO-99/64243 | A1 | 12/1999 |

* cited by examiner

*Primary Examiner* — Charlie Peng
(74) *Attorney, Agent, or Firm* — Birch, Stewart, Kolasch & Birch, LLP

(57) ABSTRACT

A liquid application apparatus has: an application member that has an application surface applying a liquid onto a medium; a holding member that abuts against the application surface of the application member so as to form a liquid holding space in which the liquid is held; a liquid application device that rotates the application surface of the application member in such a manner that the liquid supplied from the holding member to the application surface is applied onto the medium; a storage device that stores the liquid; a first flow channel and a second flow channel that connect the storage device to the holding member; a liquid movement device that causes oscillation of the liquid in the first flow channel, the second flow channel and a flow channel including the liquid holding space to generate a flow of the liquid; and a controller that controls the liquid movement device to generate the flow of the liquid caused by the oscillation in such a manner that a product which is generated from the liquid, has a higher viscosity than the liquid and adheres to interior walls of the first flow channel and the second flow channel, is solved in the liquid or collected in the liquid.

22 Claims, 11 Drawing Sheets

LIQUID APPLICATION APPARATUS, LIQUID STORAGE METHOD AND INKJET RECORDING APPARATUS

BACKGROUND OF THE INVENTION

1. Field of the Invention

The present invention relates to a liquid application apparatus, a liquid storage method and an inkjet recording apparatus, and more particularly to a liquid application apparatus, a liquid storage method and an inkjet recording apparatus which apply a liquid taken from a tank, onto a medium.

2. Description of the Related Art

An inkjet recording apparatus comprising a mechanism that applies a liquid to a recording medium with the object of quickening the aggregation of pigment when recording with inks that use pigments for colorants are well known in the field of inkjet recording apparatuses. Japanese Translation of PCT Application No. 2002-517341 discloses accumulation of a coating liquid between a roller and a doctor blade and supply of the coating liquid to the roller as the roller rotates. Then, in Japanese Translation of PCT Application No. 2002-517341, as the roller to which the coating liquid has been applied rotates, the supplied coating liquid is transferred and applied to a support member that is transported between this roller and another roller. Japanese Patent Application Publication No. 8-72227 also indicates a mechanism in an inkjet recording apparatus for applying a treatment liquid that makes dye insoluble onto recording paper prior to recording. Example 1 of Japanese Patent Application Publication No. 8-72227 discloses that the treatment liquid present in a supplementary tank is discharged by adhering to a rotating roller, and the discharged treatment liquid is applied to the recording paper.

Nonetheless, both of the configurations disclosed in the above Japanese Translation of PCT Application No. 2002-517341 and Japanese Patent Application Publication No. 08-72227 supply or feed the application liquid onto the surface of a rod bar or roller based on the rotation of the rod bar or roller, and the part of the application liquid that is supplied or fed is exposed to or is in communication with the atmosphere. For that reason, in addition to such problems as evaporation of the application liquid, there is the possibility that leakage of the application liquid will occur if the positioning of the apparatus is changed. Specifically, when considering leakage of liquid caused by positioning changes during transport of an inkjet recording apparatus such as a printer, it is difficult to utilize the application mechanisms disclosed in Japanese Translation of PCT Application No. 2002-517341 and Japanese Patent Application Publication No. 8-72227 in a small-scale apparatus.

To address these problems, Japanese Patent Application Publication No. 2005-254809 discloses a mechanism that seals the part that supplies the application liquid to the roller. In the application mechanism described in Japanese Patent Application Publication No. 2005-254809, the member that supplies liquid to the roller is configured by providing a ring-shaped elastic roller abutment member on one surface of the space forming base member. Based on this configuration, when the roller abutting member abuts the application roller by the energizing force of a spring member or the like, abutment along the circumferential shape of the application roller is enabled, and abutment with uniform pressure is realized. As a result, this becomes a substantially sealed space based on one surface of the space forming base member and the circumferential surface of the application roller, and the application liquid is maintained in this space. Then, when rotation of the application roller has stopped, the abutment member and the circumferential surface of the application roller are maintained in a sealed liquid state, and leakage of liquid to the outside is prevented.

In this regard, in Japanese Patent Application Publication No. 2005-254809 a pump is provided between the tank for the purpose of storing the application liquid and the application mechanism, and by using this pump to suction the application liquid of the application mechanism, the ink is recovered into the tank from the application mechanism, moreover, the ink is suctioned into the application mechanism from the tank by negative pressure generated by the application mechanism. In this way, in between operations of the apparatus, the pump causes the application liquid to flow, and when printing ends, the application liquid in the application mechanism and the tube is recovered into the tank, evaporation of the application liquid and generation of increased viscosity and adhesion of the application liquid is thereby prevented. However, this does not mean that all liquid in the tube can be completely recovered, and some remains in the supply channel and the recovery channel. For example, liquid may remain on the wall surfaces of the supply and recovery channels, which are cylindrical tubes, inside the changeover valve, on wall surfaces of the liquid holding member, inside the pump, and the like. Specifically, liquid is prone to remain on the wall surfaces of the liquid holding member, inside the changeover valve, and inside the pump because these parts incorporate mechanisms. The evaporation of the liquid remaining inside the apparatus, such as in the supply channel and the pump, will progress until liquid is supplied in the next filling process. Then, the viscosity of the liquid increases as evaporation progresses. As the viscosity of the liquid increases, the liquid becomes paste-like (also called viscous substance), and can become a solid of solidified liquid (also called solidified substance). When liquid is filled the next time, the paste-like liquid hinders the flow of liquid in the flow channels because the viscosity is higher than that of normal liquid. Moreover, if viscosity has increased in the application mechanism, the new liquid that could be filled without increased viscosity and the viscous liquid simultaneously slip through the nip part, and differences in the thickness of the liquid that has slipped through may appear because of the differences in the respective surface tensions. For this reason, application unevenness may appear on the application medium. Moreover, if solidified substance in generated, clogging in the channels through which the liquid circulates may occur. In this way, viscous substance and solidified substance may cause the supply and recovery of liquid to be unsatisfactory. Moreover, application of liquid to the application medium may not be conduced with high quality.

Japanese Patent Application Publication No. 2006-167556 discloses an apparatus that provides in at least one of the application liquid supply and recovery channels an avoidance space Q that maintains separation of viscous substance and solidified substance from application fluid, and prevents inhibition of satisfactory supply and ejection of application liquid in the application liquid chamber, flow channels, and pump when the apparatus is stopped for long periods of time, and when application liquid has evaporated, increased in viscosity and solidified in the supply channel. Here, even when providing this kind of avoidance space, over long-term use the avoidance space may be evaded allowing viscous substance and solidified substance to slip through, or the avoidance space may become full thereby inhibiting satisfactory supply and ejection of application liquid and producing adverse effects such as application unevenness. Consequently, stability during long-term use, and countermeasures to increased viscosity and solidification of the application fluid caused by evaporation and the like have been sought.

SUMMARY OF THE INVENTION

The present invention has been contrived in view of these circumstances, an object thereof being to provide a liquid application apparatus, a liquid storage method and an inkjet recording apparatus, and more particularly to a liquid application apparatus, a liquid storage method and an inkjet recording apparatus which can achieve good supply and recovery of a liquid and control quality degradation of liquid application.

In order to attain an object described above, one aspect of the present invention is directed to a liquid application apparatus comprising: an application member that has an application surface applying a liquid onto a medium; a holding member that abuts against the application surface of the application member so as to form a liquid holding space in which the liquid is held; a liquid application device that rotates the application surface of the application member in such a manner that the liquid supplied from the holding member to the application surface is applied onto the medium; a storage device that stores the liquid; a first flow channel and a second flow channel that connect the storage device to the holding member; a liquid movement device that causes oscillation of the liquid in the first flow channel, the second flow channel and a flow channel including the liquid holding space to generate a flow of the liquid; and a controller that controls the liquid movement device to generate the flow of the liquid caused by the oscillation in such a manner that a product which is generated from the liquid, has a higher viscosity than the liquid and adheres to interior walls of the first flow channel and the second flow channel, is solved in the liquid or collected in the liquid.

According to the aforementioned aspect, viscous substance and solidified substance can be re-dissolved or incorporated into the liquid when product substances (viscous substance, solidified substance) have been produced by evaporation and the like of the liquid (for example, application liquid), and therefore inhibition of the supply and recovery of liquid between the holding member and the storage device can be reduced, and satisfactory supply and recovery of liquid can be conducted. Moreover, application unevenness on an application medium can be reduced, and high quality liquid application can be conducted.

Desirably, the controller controls the liquid movement device in such a manner that the oscillation of the liquid is caused when the liquid application apparatus is turned off.

Desirably, the controller controls the liquid movement device in such a manner that a phase difference is provided between a phase of the oscillation caused by the liquid movement device and a phase of the flow of the liquid in the first flow channel and the second flow channel.

According to the aforementioned aspect, turbulent flow tends to be produced by the aforementioned phase difference, and therefore product substance can be more effectively recovered into the liquid.

Desirably, the controller controls the liquid movement device to generate the flow of the liquid in the first flow channel, the second flow channel and a flow channel including the liquid holding space in such a manner that the flow channels oscillate when the liquid is restored into the storage device due to the flow.

According to the aforementioned aspect, for example, even if the product substance has not been solved into the liquid in the flow channels, the product substance can be incorporated into the liquid and recovered into the storage device.

Desirably, the liquid movement device performs a forward driving such that force is applied to the liquid so as to send the liquid from the storage device to the holding member, and a backward driving such that force is applied to the liquid so as to send the liquid from the holding member to the storage device, and the controller controls the liquid movement device to generate the flow of the liquid caused by the oscillation in such a manner that when the liquid movement device is switched from the forward driving to the backward driving, the liquid is moved from the storage device toward the holding member, and when the liquid movement device is switched from the backward driving to the forward driving, the liquid is moved from the holding member toward the storage device.

Desirably, the controller controls the liquid movement device in such a manner that the force applied to the liquid during the forward driving is larger than the force applied to the liquid during the backward driving.

Desirably, the controller controls the liquid movement device in such a manner that time of applying the force to the liquid during the forward driving is longer than time of applying the force to the liquid during the backward driving.

Desirably, the controller controls the liquid movement device in such a manner that the oscillation of the liquid is caused when the liquid is sent to the holding member from the storage device so as to fill the liquid holding space with the liquid.

Another aspect of the present invention is directed to an inkjet recording apparatus comprising: one of the liquid application apparatuses defined above; a recording head that ejects an ink; and a recording device that causes the recording head to eject the ink onto a medium to which the liquid application apparatus has applied the liquid.

Another aspect of the present invention is directed to a liquid storage method of a liquid application apparatus having an application member that has an application surface applying a liquid onto a medium, a holding member that abuts against the application surface of the application member so as to form a liquid holding space in which the liquid is held, a liquid application device that rotates the application surface of the application member in such a manner that the liquid supplied from the holding member to the application surface is applied onto the medium, a storage device that stores the liquid, and a first flow channel and a second flow channel that connect the storage device to the holding member, the liquid storage method comprising: a liquid movement step of causing oscillation of the liquid in the first flow channel, the second flow channel and a flow channel including the liquid holding space to generate a flow of the liquid; and a recovery step of generating the flow of the liquid caused by the oscillation in such a manner that a product which is generated from the liquid, has a higher viscosity than the liquid and adheres to interior walls of the first flow channel and the second flow channel, is solved in the liquid or collected in the liquid.

Desirably, the oscillation of the liquid is caused when the liquid application apparatus is turned off.

Desirably, in the recovery step, a phase difference is provided between a phase of the oscillation caused by the liquid movement device and a phase of the flow of the liquid in the first flow channel and the second flow channel.

Desirably, in the recovery step, the flow of the liquid in the first flow channel, the second flow channel and a flow channel including the liquid holding space is generated in such a manner that the flow channels oscillate when the liquid is restored into the storage device due to the current.

Desirably, the liquid movement step includes a forward driving step of applying force to the liquid so as to send the liquid from the storage device to the holding member, and a backward driving step of applying force to the liquid so as to send the liquid from the holding member to the storage device, and in the recovery step, the flow of the liquid caused by the oscillation is generated in such a manner that when a driving step is switched from the forward driving step to the backward driving step, the liquid is moved from the storage device toward the holding member, and when the driving step is switched from the backward driving step to the forward driving step, the liquid is moved from the holding member toward the storage device.

Desirably, the force applied to the liquid during the forward driving step is larger than the force applied to the liquid during the backward driving step.

Desirably, time of applying the force to the liquid during the forward driving step is longer than time of applying the force to the liquid during the backward driving step.

Desirably, the oscillation of the liquid is caused when the liquid is sent to the holding member from the storage device so as to fill the liquid holding space with the liquid.

According to the present invention, viscous substance and solidified substance can be re-dissolved or incorporated into the liquid when product substances (viscous substance, solidified substance) produced by evaporation, and the like, of liquid (for example, application liquid) have been generated, and therefore inhibition of the supply and recovery of liquid between the holding member and the storage device can be reduced, and satisfactory supply and recover of liquid can be conducted. Moreover, application unevenness on the application medium can be reduced, and high quality liquid application can be conducted.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Preferred embodiments of a liquid application apparatus, a liquid storage method and an inkjet recording apparatus are described below with reference to the attached drawings.

Inkjet Recording Apparatus

Firstly, an inkjet recording apparatus which is one embodiment of an image forming apparatus relating to the present invention will be described.

Figure 1:
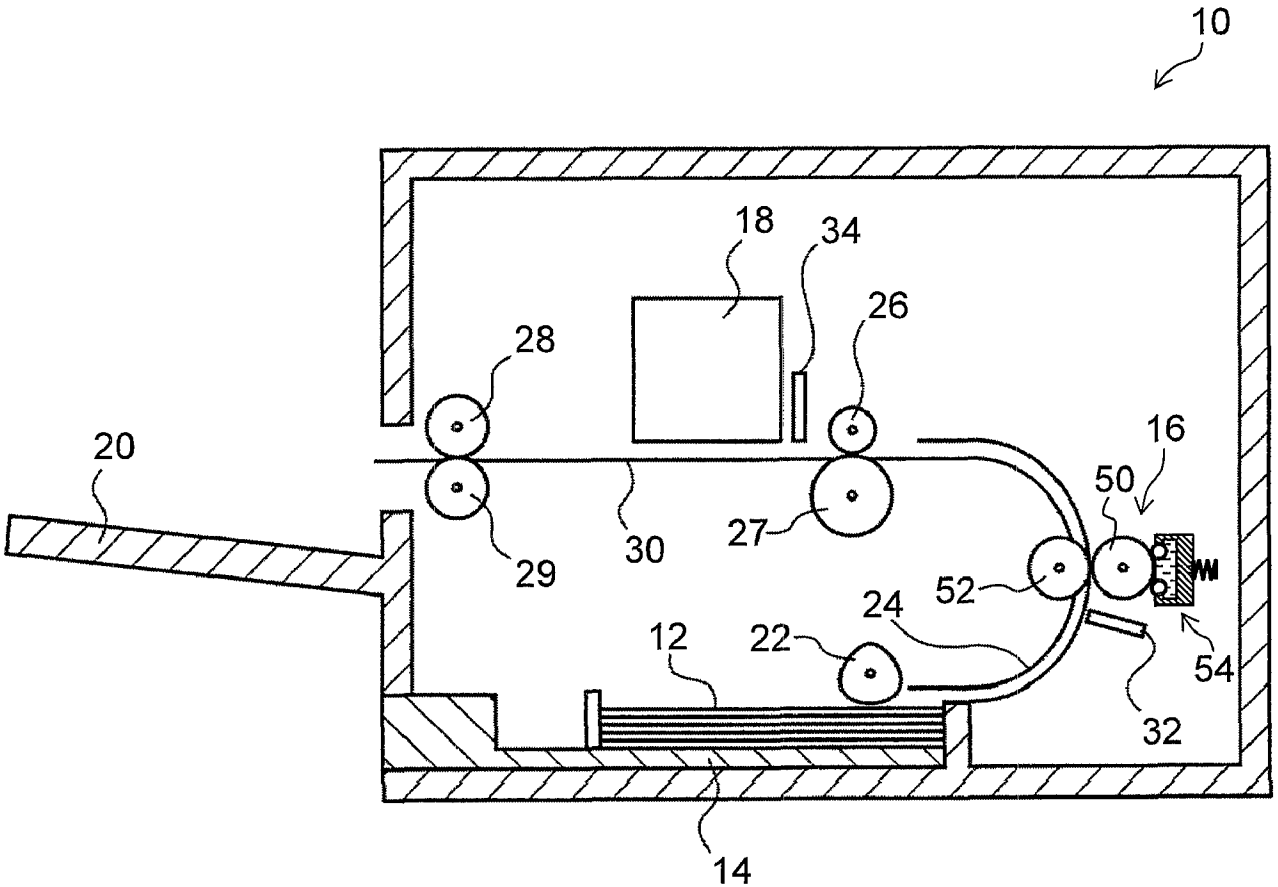
FIG. 1 is a general schematic drawing illustrating an approximate view of an inkjet recording apparatus relating to one embodiment of the present invention.

FIG. 1 is a schematic drawing illustrating an overview of an inkjet recording apparatus relating to the present embodiment. As illustrated in FIG. 1, the inkjet recording apparatus 10 comprises: a paper supply unit 14 which supplies a recording medium 12; a treatment liquid application unit 16 which applies treatment liquid to the recording medium 12 supplied from the paper supply unit 14; an ink droplet ejection unit 18 which ejects droplets of ink onto the recording medium 12 after the deposition of treatment liquid; and an output tray 20 which outputs the recording medium 12 onto which an image has been formed by the ink droplet ejection unit 18.

The paper supply unit 14 employs a method based on a paper supply cassette in which a plurality of sheets of recording media 12 cut to a prescribed size are loaded. It is also possible to provide a plurality of paper supply cassettes in such a manner that papers of a plurality of different sizes can be supplied. Furthermore, it is also possible to adopt a mode in which rolled paper (continuous paper) is used instead of cut sheet, and the rolled paper is cut to an appropriate size by a cutter.

The treatment liquid application unit 16 comprises a treatment liquid application device which applies treatment liquid to a recording medium 12, and a treatment liquid supply device which supplies the treatment liquid to the treatment liquid application device.

The treatment liquid application device is constituted by a round cylindrical application roller 50 forming an application member, a round cylindrical counter roller (medium supporting member, backup roller) 52 which is disposed so as to oppose the application roller 50, and a roller drive mechanism (not illustrated) which drives the application roller 50, and the like. The application roller 50 and the counter roller 52 are respectively supported rotatably by mutually parallel axes of which the respective ends are installed rotatably on a frame (not illustrated).

The treatment liquid supply device comprises: a liquid holding member 54 which holds the treatment liquid between the liquid holding member 54 and the circumferential surface of the application roller 50, and a liquid supply apparatus (not illustrated) which supplies the treatment liquid to the liquid holding member 54. The liquid holding member 54 extends through the lengthwise direction of the application roller 50 and is installed movably on the aforementioned frame via a mechanism which enables separation from the circumferential surface of the application roller 50.

The ink droplet ejection unit 18 is provided on the downstream side of the treatment liquid application unit 16 in terms of the direction of conveyance of the medium. The ink droplet ejection unit 18 according to the present example is constituted by recording heads of an inkjet type which correspond respectively to inks of four colors of yellow (Y), magenta (M), cyan (C) and black (K). Although not illustrated in the drawings, inks of the corresponding colors are supplied respectively to the recording heads of the respective colors, from ink tanks which are not illustrated.

The recording heads of the respective colors in the ink droplet ejection unit 18 are each heads of a full line type which respectively have a length corresponding to the maximum width of the image forming region on the recording medium 12 and comprise a plurality of ink ejection nozzles arranged through the full width of the image forming region on the ink ejection surface of the head.

The recording heads of the respective colors are fixed so as to extend in a direction perpendicular to the direction of conveyance of the recording medium 12 (the direction perpendicular to the plane of the drawing in FIG. 1), and respectively eject liquid droplets of the corresponding colored ink onto the recording medium 12 on the platen 30.

In this way, according to a composition in which full line heads having nozzle rows covering the full width of the image forming region of the recording medium 12 are provided for each color of ink, it is possible to record an image on the image forming region of the recording medium 12 by performing just one operation of moving the recording medium 12 and the recording head relatively with respect to each other in the direction of conveyance of the recording medium 12 (the sub-scanning direction), in other words, by performing just one sub-scanning.

It is also possible to adopt a mode which employs, instead of full line heads, heads of a serial (shuttle) type which move reciprocally back and forth in a direction (main scanning direction) perpendicular to the direction of conveyance of the recording medium 12 (sub-scanning direction), but forming an image by a single pass method using heads of a full line type (page-wide heads) enables faster printing than a multi-pass method using serial (shuttle) type heads, and therefore the print productivity can be improved.

Although the configuration with the CMYK four colors is described in the present embodiment, combinations of the ink colors and the number of colors are not limited to those. Light inks, dark inks or special color inks can be added as required. For example, a configuration is possible in which recording heads for ejecting light-colored inks such as light cyan and light magenta are added. Furthermore, there are no particular restrictions of the sequence in which the heads of respective colors are arranged.

Possible examples of the ink used in the inkjet recording apparatus 10 according to the present embodiment include a dye-based ink in which a coloring material is dissolved in a molecular state (an ionic state is also possible) in the solvent of the liquid, and a pigment-based ink in which a coloring material is dispersed in the solvent of the liquid in a state of small particles.

Here, an explanation specifically of pigment ink will be given. The weight ratio of the pigment of the pigment ink used in this embodiment is in the range of 1 to 20 percent by weight in relation to the total weight of the pigment ink, desirably in the range of 2 to 12 percent by weight. Carbon black, for example carbon black produced by the furnace method or channel method, may be cited as black pigment, and desirably substance with characteristics as a primary particle diameter of 15 to 40 mμ (nm), a relative surface area using the BET method of 50 to 300 $m^2/g$, a DBP oil absorption of 40 to 150 ml/100 g, a volatile matter content of 0.5 to 10%, and a pH 2 to 9 is used, and the like. Commercial products having these kinds of characteristics include No. 2300, No. 900, MCF88, No. 33, No. 40, No 45, No. 52, MA7, MA8, No. 2200B (manufactured by Mitsubishi Chemical Corporation), RAVEN 1255 (manufactured by Columbia), REGAL 400R, REGAL 330R, REGAL 660R, MOGULL (manufactured by Cabot Corporation), and Color Black FW1, Color Black $FW_{18}$, Color Black S170, Color Black S150, Printex 35, Printex U (manufactured by Degussa).

Examples of yellow pigments include C.I. Pigment Yellow 1, C.I. Pigment Yellow 2, C.I. Pigment Yellow 3, C.I. Pigment Yellow 13, C.I. Pigment Yellow 16, C.I. Pigment Yellow 83 and the like.

Examples of magenta pigments include C.I. Pigment Red 5, C.I. Pigment Red 7, C.I. Pigment Red 12, C.I. Pigment Red 48 (Ca), C.I. Pigment Red 48 (Mn), C.I. Pigment Red 57 (Ca), C.I. Pigment Red 112, C.I. Pigment Red 122, and the like.

Further, examples of cyan pigments include C.I. Pigment Blue 1, C.I. Pigment Blue 2, C.I. Pigment Blue 3, C.I. Pigment Blue 15:3, C.I. Pigment Blue 16, C.I. Pigment Blue 22, C.I. Vat Blue 4, C.I. Vat Blue 6, and the like. In addition to the above, newly manufactured pigments such as self-dispersing type pigments may of course be used.

Any kind of water-soluble resin pigment dispersing agent may be used. Here, the weight average molecular weight is desirably in the range of 1,000 to 30,000, and more desirably in the range of 3,000 to 15,000. Specifically, block copolymers or random copolymers, graft copolymers, or salts of these comprising at least two or more monomers (at least one of which is a hydrophilic polymerizable monomer) selected from styrene, styrene derivative, vinyl naphthalene, vinyl naphthalene derivative, aliphatic alcohol esters of α,β-ethylene unsaturated carboxylic acid, acrylic acid, acrylic acid derivative, maleic acid, maleic acid derivative, itaconic acid, itaconic acid derivative, fumaric acid, fumaric acid derivative, vinyl acetate, vinyl pyrrolidone, acrylamide, and derivatives thereof may be cited. Further, natural resins such as rosin, shellac, and starch can be used in desirable states. These resins are soluble in aqueous solutions in which a base is dissolved, and are alkali soluble type resins. Further, these water-soluble resins used as pigment dispersing agents are desirably contained in the range of 0.1 to 5 percent by weight in relation to the total weight of the pigment ink.

When using pigment inks containing the pigments described above, the overall pigment ink is desirably adjusted to neutral or alkaline. This is because, with this kind of substance, the solubility of the water-soluble resin to be used as the pigment dispersing agent is improved, and a pigment ink altogether superior in long-term storage characteristics can be made. However, in this case, there is the possibility of corrosion of various members used in the inkjet recording apparatus, and therefore, if at all possible, adjustment to within the range of pH 7 to 10 is desirable. Examples of pH adjusting agents to be used in this situation include various types of organic amines such as diethanolamine, and triethanolamine, inorganic alkali agents of alkali metal hydroxides such as sodium hydroxide, lithium hydroxide, and potassium hydroxide, as well as organic acids and mineral acids. The aforementioned pigments and water-soluble resins that are dispersing agents are dispersed and dissolved in an aqueous liquid medium.

In the pigment ink of the present embodiment, desirably the aqueous liquid medium used is a mixed solution of water and water-soluble organic solvents. In this case, not general water containing various ions, but rather ion-substituted water (deionized water) is desirably used as the water.

Examples of the water-soluble organic solvents mixed and used with water include: alkyl alcohols with a carbon number of 1 to 4 such as methyl alcohol, ethyl alcohol, n-propyl alcohol, isopropyl alcohol, n-butyl alcohol, sec-butyl alcohol, and tert-butyl alcohol; amides such as dimethylformamide, and dimethylacetamide; ketone or keto-alcohols such as acetone, and diacetone alcohol; ethers such as tetrahydrofuran, and dioxane; polyalkylene glycols such as polytheylene glycol, and polypropylene glycol; alkylene glycols in which the alkylene group contains 2 to 6 carbon atoms such as ethylene glycol, propylene glycol, butylene glycol, triethylene glycol, 1,2,6-hexane triol, thiodiglycol Hexylene glycol and diethylene glycol; glycerin; lower alkyl ethers of polyvalent alcohols such as, ethylene glycol monomethyl (or ethyl) ether, diethylene glycol methyl (or ethyl)ether, and triethylene glycol monomethyl (or ethyl)ether; and miscellaneous solvents, such as N-methyl-2-pyrrolidone, 2-pyrrolidone and 1,3-dimethyl-2-imidazolidinone. Among these water soluble organic solvents, use of polyvalent alcohols such as diethylene glycol and lower alkyl ethers of polyvalent alcohols such as triethylene glycol monomethyl (or ethyl)ether is more desirable.

The desirable content of the aforementioned water-soluble organic solvent in the pigment ink is generally in a range of 3 to 50 percent by weight, and more desirably in the range of 3 to 40 percent by weight. Moreover, the water content is in the range of 10 to 90 percent by weight of the overall weight of the pigment ink, desirably in the range of 30 to 80 percent by weight.

In addition to the aforementioned components, surfactants, defoaming agents, and preservatives may be suitably added to the pigment inks that can be used in the present invention as necessary in order to make a pigment ink that has desirable physical values. Specifically, it is strongly desirable that a suitable amount of a surfactant that functions as penetration enhancer be added in order to play the role of causing the liquid components of the pigment ink to rapidly penetrate the recording medium. The amount added is 0.05 to 10 percent by weight, and more desirably, 0.5 to 5 percent by weight. Any of the generally used anionic surfactants such as the carboxylic acid salt type, sulfuric acid ester type, sulfonic acid salt type, and phosphoric acid ester type may be suitably used.

The method for manufacturing the aforementioned pigment ink is to first add the aforementioned pigment to an aqueous medium containing at least water and a water-soluble resin as a dispersing agent, and then to mix and agitate. Afterwards this is dispersed using a dispersing device to be described later, and the desired dispersion liquid is obtained by centrifugal separation processing as necessary. Next, a sizing agent and suitably selected additive components like those cited above are added, agitated, and made into a pigment ink.

Further, if using an alkali soluble resin as the dispersing agent, it is necessary to add a base in order to dissolve the resin. Desirably, organic amines such as monoethanolamine, diethanolamine, triethanolamine, amine methylpropanol, and ammonia, and inorganic bases such as potassium hydroxide, and sodium hydroxide may be used.

In the method of forming the pigment ink containing a pigment, it is effective to premix by agitation the aqueous medium containing a pigment for at least 30 minutes before the dispersion treatment. This kind of premixing operation is desirable because it improves the wettability of the pigment surfaces, and promotes adsorption of the dispersant to the pigment surfaces.

Any dispersion machines which are generally used can be used for the dispersion treatment of the pigment. Examples of dispersion machines which can desirably be used include a ball mill, a roll mill, a sand mill and the like. Of these machines, a high-speed sand mill is desirably used. Super Mill, Sand Grinder, Beads Mill, Agitator Mill, Grain Mill, Dyno Mill, Pearl Mill and Cobol Mill (all of which are trade names) are examples of high-speed sand mills.

Generally, when the ink containing a pigment is used in the inkjet recording apparatus, a pigment having an optimum particle size distribution is selected in order to prevent clogging. Methods of obtaining a pigment having a desired particle size distribution include decreasing the size of the grinding medium of the dispersion machine, increasing the packing rate of the grinding medium, increasing the treatment time, decreasing the discharge speed, classifying particles by a filter or a centrifugal separator after grinding, and combinations of these methods.

On the other hand, the treatment liquid is a liquid which generates an aggregate of the coloring material when mixed with an ink. Specific examples of the treatment liquid include a treatment liquid which precipitates or insolubilizes the coloring material in the ink by reacting with the ink, and a treatment liquid which generates a semi-solid material (gel) that includes the coloring material in the ink, and the like.

A method of generating a reaction between the ink and the treatment liquid may be a method which causes an anionic coloring material in the ink with a cationic compound in the treatment liquid, a method which aggregates pigment by breaking down the dispersion of the pigment in the ink due to altering the pH of the ink by mixing an ink and a treatment liquid which have different pH values, a method which aggregates pigment by breaking down the dispersion of the pigment in the ink due to a reaction with a polyvalent metal salt in the treatment liquid, or the like.

For instance, examples of a treatment liquid having an action of aggregating the coloring material contained in ink which is ejected as droplets from the ink droplet ejection unit 18 according to the present embodiment are aggregating treatment agents, such as a polyvalent metal salt, polyallylamine, a polyallylamine derivative, an acidic liquid, a cationic surfactant, and the like. By promoting the aggregation of the coloring material on the recording medium 12 by means of a treatment liquid of this kind, it is possible to improve the recording density as well as reducing or preventing bleeding.

Any liquid in the viscosity range of the present invention may be used as the liquid of the present invention, but the aggregation treatment agent indicated below is desirable.

Examples of the reaction liquid used in the present invention are substances containing polyvalent metal salts, polyallylamine, polyallylamine derivative, acidic solution, cationic surfactants, and the like.

When the reaction agent is a polyvalent metal salt, desirable examples include metal salts that are composed of divalent or greater polyvalent metal ions and an anion bonded to these polyvalent metal ions, and that are soluble in water. Specific examples include divalent metal ions such as $Ca^{2+}$, $Cu^{2+}$, $Ni^{2+}$, $Mg^{2+}$, $Zn^{2+}$ and $Ba^{2+}$, and trivalent metal ions such as $Al^{3+}$, $Fe^{3+}$, and $Cr^{3+}$. Examples of the anion for forming the salt include $Cl^-$, $NO_3^-$, $I^-$, $Br^-$, $ClO_3^-$, and $CH_3COO^-$.

Notably, from the double perspective of the reaction liquid pH and the quality of the printed object to be obtained, the metal salts composed of $Ca^{2+}$ or $Mg^{2+}$ yield desirable results.

The concentration of these polyvalent metal salts in the reaction liquid is suitably determined in a range that obtains the effects of suitable print quality and prevention of clogging, but desirably is about 0.1 to 40 percent by weight, and more desirably is about 5 to 25 percent by weight.

In the desirable aspect of the present invention, the polyvalent metal salt contained in the reaction liquid is composed of a divalent or greater polyvalent metal ion and nitric acid ion or carboxylic acid ion bonded to these polyvalent metal ions, and is soluble in water.

Here, the carboxylic acid ions are desirably derivative from saturated aliphatic monocarboxylic acid with 1 to 6 carbon atoms or carbocyclic monocarboxylic acid with 7 to 11 carbon atoms. Desirable examples of saturated aliphatic monocarboxilic acids with 1 to 6 carbon atoms include formic acid, acetic acid, propionic acid, butyric acid, isobutyric acid, valeric acid, isovaleric acid, pivalic acid, and hexanoic acid. In particular, formic acid and acetic acid are desirable.

The hydrogen atoms on the saturated aliphatic hydrocarbon groups of this monocarboxylic acid may be substituted with hydroxide groups, and a desirable example of this kind of carboxylic acid is lactic acid.

Further, desirable examples of carbocyclic monocarboxylic acid with 6 to 10 carbon atoms include benzoic acid and naphthoic acid, and benzoic acid is more desirable.

The polyallylamine and polyallylamine derivatives desirably used as the reaction agent are cationic macromolecules that are positively charged in water. Examples include the substances in Formula (I), Formula (II), and Formula (III) below.

Chemical Formulae (I) to (III)

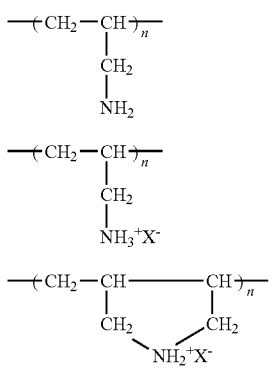

(In the formulae, $X^-$ represents chloride ion, bromide ion, iodide ion, nitrate ion, phosphate ion, sulfate ion, acetate ion, and the like.) In addition to these, polymers in which arylamine and diarylamine are copolymerized, and copolymers of diarylmethyl ammonium chloride and sulfur dioxide may be used. Desirably, the content of these polyallylamines and polyallylamine derivatives is 0.5 to 10 percent by weight of the reaction liquid.

Desirably, the following kinds of acids are used as components of the treatment liquid. These acids may be selected from polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, cumaric acid, thiophene carboxylic acid, nicotinic acid, or derivatives of these compounds, or salts of these, or the like.

According to a desirable aspect of embodiments of the present invention, the reaction liquid may contain a wetting agent comprising an organic solvent with a high boiling point. The organic solvent with a high boiling point is added to prevent drying of the reaction liquid and inhibit clogging of the head. Examples of organic solvents with a high boiling point duplicate some of the previously described polyols, and include polyhydric alcohols such as ethylene glycol, diethylene glycol, triethylene glycol, polyethylene glycol, polypropylene glycol, propylene glycol, butylene glycol, 1,2,6-hexane triol, thioglycol, hexylene glycol, glycerin, trimethylolethane, and trimethylolpropane, alkyl ethers of polyhydric alcohols such as ethylene glycol monoethyl ether, ethylene glycol monobutyl ether, diethylene glycol monomethyl ether, diethylene glycol monoethyl ether, diethylene glycol monobutyl ether, triethylene glycol monomethyl ether, triethylene glycol monoethyl ether, and triethylene glycol monobutyl ether, or urea, 2-pyrrolidone, N-methyl-2-pyrrolidone, 1,3-dimethyl-2-imidazolidinone, and triethanolamine.

The amount of high boiling point organic solvent added is not particularly limited, and is desirably about 0.5 to 40 percent by weight, more desirably about 2 to 20 percent by weight.

According to a desirable aspect of the present invention, the reaction liquid may also contain low boiling point organic solvents. Examples of desirable low boiling point organic solvents include methanol, ethanol, n-propyl alcohol, isopropyl alcohol, n-butanol, sec-butanol, tert-butanol, isobutanol, and n-pentanol. Specifically, monovalent alcohols are desirable. Low boiling point organic solvents have the effect of shortening the ink drying time. The amount of low boiling point organic solvent added is desirably about 0.5 to 10 percent by weight, more desirably in the range of about 1.5 to 6 percent by weight.

According to a desirable aspect of the present invention, the reaction liquid may also contain penetrating agents. Examples of penetrating agents include: various types of surfactants such as anionic surfactants, cationic surfactants, and ampholytic surfactants; alcohols such as methanol, ethanol, and isopropyl alcohol; and low grade allyl ethers of polyvalent alcohols such as ethylene glycol monomethyl ether, diethylene glycol monoethyl ether, diethylene glycol monobutyl ether, triethylene glycol monobutyl ether, propylene glycol monobutyl ether, and dipropylene glycol monobutyl ether.

Further, the reaction liquid may be colored by adding colorants, which will be explained later in the paragraph on ink composition, and thus may be configured to combine ink composition functions.

The viscosity of the application liquid of the present invention must be between 5 mPa·s to 200 mPa·s. Desirably, the viscosity is 7 mPa·s to 100 mPa·s, and more desirably is 10 mPa·s to 50 mPa·s.

The means to adjust the viscosity of the liquid of embodiments of the present invention to viscosity of the present invention includes the method of combining according to the types and amounts of the above-described high boiling point organic solvents to be added, and the method of combining by adding the water-soluble polymers.

As long as it is a water-soluble polymer, any water-soluble polymer will do, and gelatin, polyvinyl pyrrolidone, polyethylene oxide, polyacrylate, polyacrylamide, polyvinyl alcohol, polysaccharide thickener, and the like may be used, but in view of a large increase in viscosity from a small amount added, polyacrylate, polyacrylamide and polysaccharide thickener are more desirable. Desirably, the molecular weight is about 10,000 to 500,000.

Examples of the composition of the treatment liquid (treatment liquid A, treatment liquid B) are described below.

Treatment liquid A

Malonic acid: 15%;

Diethylene glycol monomethyl ether (Wako Pure Chemical Industries, Ltd.): 20%; and Deionized water: 65%

Treatment liquid B

Calcium nitrate: 15%;

Glycerin (Wako Pure Chemical Industries, Ltd.): 15%; and

Deionized water: 70%

According to this composition, recording media 12 which are loaded in the paper supply unit 14 are supplied to the conveyance path 24 repeatedly, one sheet at a time, by the paper supply roller 22. When a recording medium 12 which has been supplied to the conveyance path 24 from the paper supply unit 14 is fed between the rollers 50 and 52, then the treatment liquid is applied to the recording surface of the recording medium 12 while the application roller 50 is rotated in the clockwise direction in FIG. 1 by the roller drive mechanism and thereby conveys the recording medium 12.

The recording medium 12 onto which the treatment liquid has been applied is conveyed onto a platen 30 by a pair of conveyance rollers 26, 27 and moved to a position opposing the ink droplet ejection unit 18, and ink droplets are ejected onto the recording surface of the recording medium 12 from the nozzles of the recording head, forming an image on the recording surface.

The recording medium 12 on which an image has been formed in this way is output to an output tray 20 by a pair of output rollers 28 and 29.

Medium leading edge determination sensors 32 and 34 which determine the leading edge of the recording medium 12 are disposed in the conveyance path 24 for the recording medium 12. The first medium leading edge determination sensor 32 is disposed in the vicinity of the input to the application roller 50 on the paper supply side. The second medium leading edge determination sensor 34 is disposed in the vicinity of the input to the ink droplet ejection unit 18 on the paper supply side.

The treatment liquid application timing and the ink droplet ejection timing are controlled by determining the position of the recording medium 12 by means of these sensors (32, 34).

Next, the composition of the treatment liquid application unit 16 will be described in detail.

Figure 2:
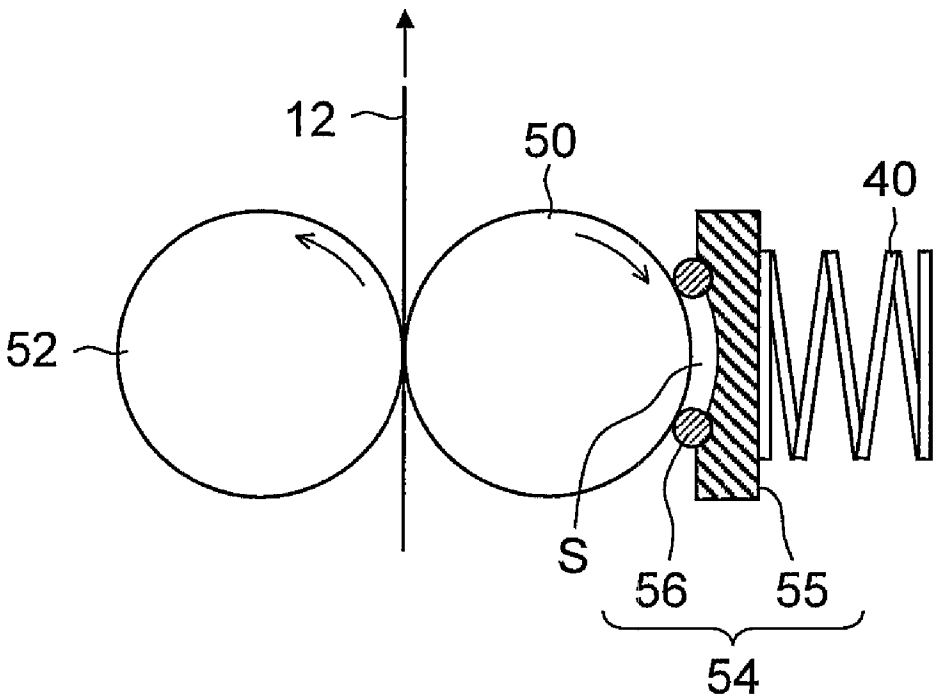
FIG. 2 is a cross-sectional diagram illustrating the composition of a treatment liquid application unit.
Figure 3:
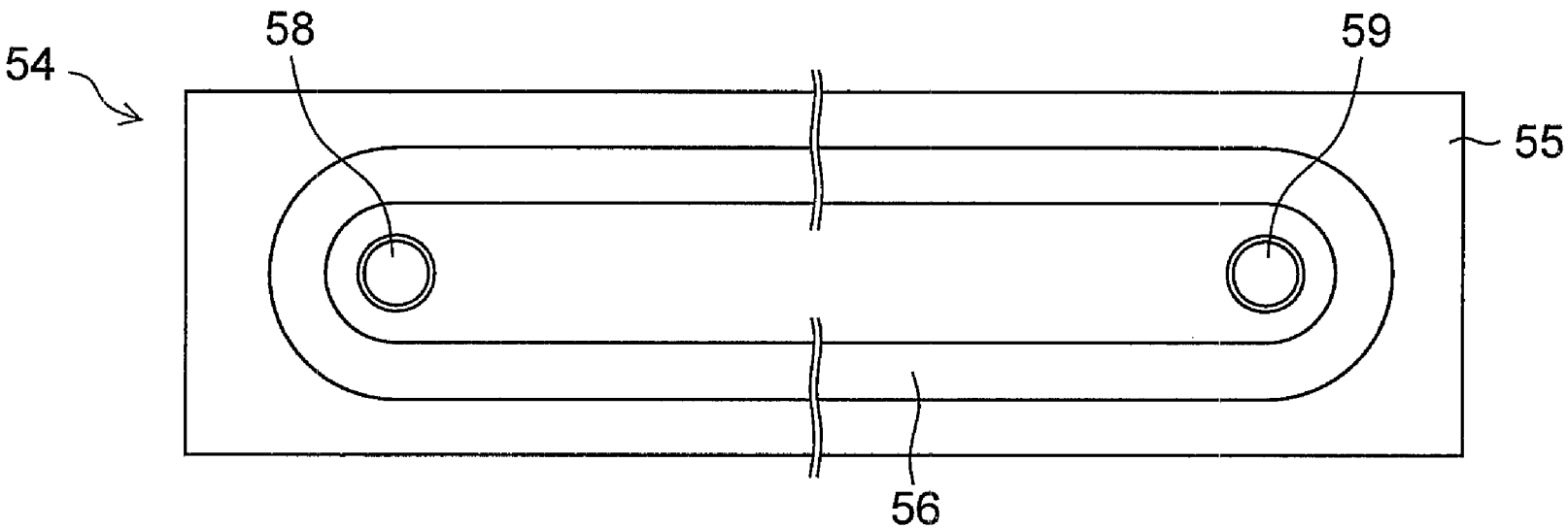
FIG. 3 is a plan diagram illustrating the composition of a liquid holding member.

FIG. 2 is a cross-sectional diagram illustrating the composition of the treatment liquid application unit 16. FIG. 3 is a plan diagram illustrating the composition of the liquid holding member 54.

The counter roller 52 is impelled toward the circumferential surface of the application roller 50 by an impelling device (not illustrated), and by rotating the application roller 50 in the clockwise direction in FIG. 2, the recording medium 12 is conveyed in the direction of the arrow in FIG. 2 while the recording medium 12 to which the treatment liquid is to be applied is gripped between the two rollers.

Furthermore, a spring member 40 is provided on the rear surface side of the liquid holding member 54 which constitutes the liquid supply device, and the liquid holding member 54 is impelled toward the circumferential surface of the application roller 50 by the impelling force of the spring member 40. The liquid holding member 54 is constituted by a space forming base member 55, and a ring-shaped abutting member 56 which is provided in a projecting manner on one surface of the space forming base member 55. By this means, in a state where the abutting member 56 of the liquid holding member 54 is abutted (in tight contact) so as to press against the circumferential surface of the application roller 50, a liquid holding space S is formed which is sealed off (hermetically closed) by the abutting member 56, one surface of the space forming base member 55, and the circumferential surface of the application roller 50.

A liquid supply port 58 and a liquid return port 59 formed so as to pass through the space forming base member 55 are provided in the region of the liquid holding member 54 which is surrounded by the abutting member 56. During the printing operation (in other words, during an application operation), the treatment liquid is supplied from the liquid supply apparatus, which is described hereinafter, via the liquid supply port 58, and the treatment liquid is held in the liquid holding space S, in addition to which the treatment liquid flows inside the liquid holding space S and the treatment liquid is returned in the liquid supply apparatus via the liquid return port 59.

Figure 4:
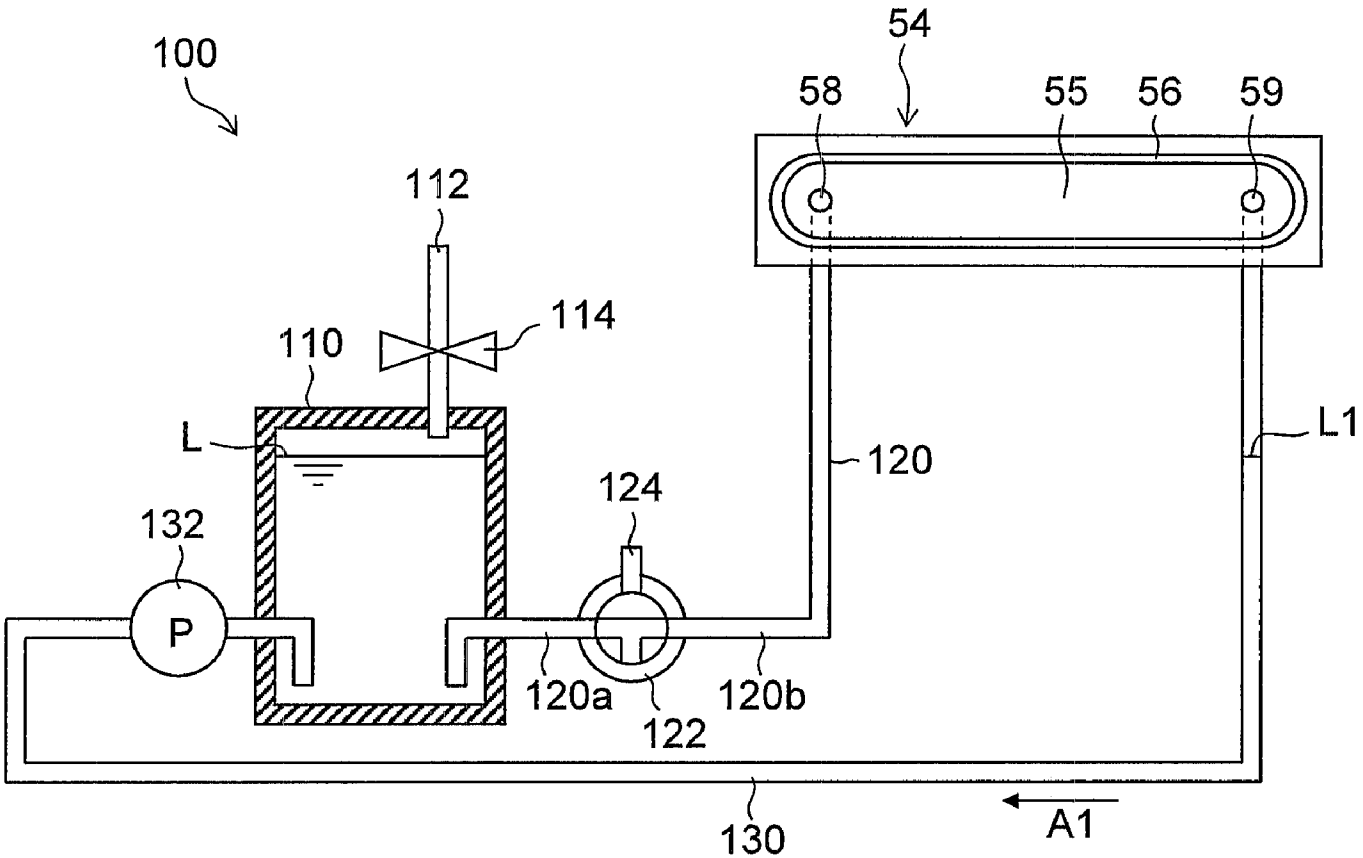
FIG. 4 is a schematic drawing illustrating an example of the composition of a liquid supply apparatus which is connected to the liquid holding member.

FIG. 4 is a schematic drawing illustrating an example of the composition of a liquid supply apparatus which is connected to the liquid holding member 54. As illustrated in FIG. 4, the liquid supply apparatus 100 comprises a storage tank 110 which stores the treatment liquid, a supply flow channel 120 for supplying the treatment liquid to the liquid supply port 58 of the liquid holding member 54 from the storage tank 110, and a return flow channel 130 for returning the treatment liquid to the storage tank 110 from the liquid return port 59 of the liquid holding member 54.

An air connection port 112 is provided in the storage tank 110, and an air connection valve 114 which switches between connecting to and shutting off the air is provided in the air connection port 112.

One end of the supply flow channel 120 is connected to the liquid supply port 58 of the liquid holding member 54, and the other end thereof is connected to the interior of the liquid layer in the storage tank 110 (a position below the surface L of the treatment liquid).

A three way valve 122 is provided in the supply flow channel 120. This three way valve 122 has three ports which are mutually connected, and two of these ports can be connected selectively to any two of the storage tank side flow channel 120*a* of the supply flow channel 120, the liquid holding member side flow channel 120*b* of the supply flow channel 120, and the air connection port 124. By switching this three way valve 122, it is possible to switch selectively between a connected state where the storage tank side flow channel 120*a* and the liquid holding member side flow channel 120*b* are connected (hereinafter, simply called a "connected state") and a connected state where the liquid holding member side flow channel 120*b* and the air connection port 124 are connected (hereinafter called an "air connected state"), and thereby it is possible to supply either the treatment liquid inside the storage tank 110 or air taken in via the air connection port 124, to the liquid holding space S formed by the liquid holding member 54 and the application roller 50.

A pump 132 is provided in the return flow channel 130. This pump 132 generates a flow which forcibly causes the liquid or air to move in the direction of the arrow A1 in FIG. 4.

One end of the return flow channel 130 is connected to the liquid return port 59 of the liquid holding member 54, and the other end thereof is connected to the liquid layer in the storage tank 110 (a position below the surface L of the treatment liquid). In other words, the position of the opening of the return flow channel 130 is below the surface L of the treatment liquid in the storage tank 110.

Figure 5:
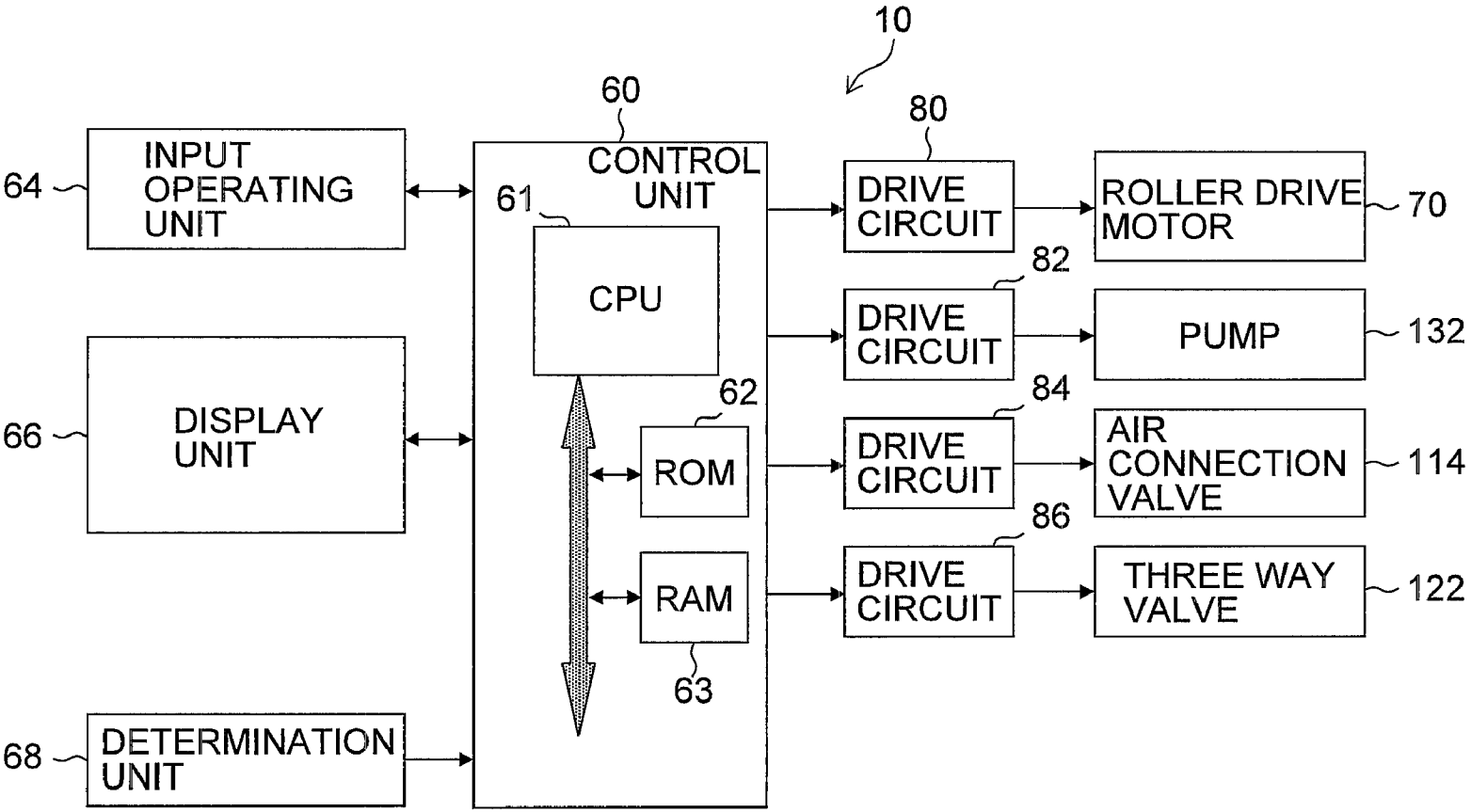
FIG. 5 is a block diagram illustrating the composition of the control system of a liquid application apparatus.

FIG. 5 is a block diagram illustrating the composition of the control system of an inkjet recording apparatus 10 according to the present embodiment.

In FIG. 5, the control section 60 (which is equivalent to a "drive control device") is a control device which performs overall control of the whole of the inkjet recording apparatus 10. The control 1 nit 60 comprises: a CPU (Central Processing Unit) 61 which executes processing of various types in accordance with prescribed programs; a ROM (Read Only Memory) 62 which stores programs, data of various types, and the like; and a RAM (Random Access Memory) 63 which temporarily stores data, and the like, that are used in the various types of processing.

The input operating unit 64 is constituted, for example, by a keyboard or mouse (or various switches, or the like) which is used to input prescribed instructions or data. The display unit 66 constitutes a user interface together with the input operating unit 64 and provides various displays in conjunction with the control unit 60. For example, the display unit 66 is constituted by a liquid display apparatus.

Furthermore, the inkjet recording apparatus 10 comprises a determination unit 68 which includes a sensor (medium size determination sensor) for determining the width size of to the recording medium 12 (see FIG. 1) (the size in the breadthways direction which is perpendicular to the medium conveyance direction), a sensor (medium position determination sensor) for determining the position of the medium, and in addition to these, a sensor which determines the operational states of the respective units, and the like. The signals from the determination unit 68 are sent to the control unit 60, and are used to drive the roller and control other operations. The determination unit 68 includes the medium leading edge determination sensors 32, 34.

Furthermore, the inkjet recording apparatus 10 comprises a roller drive motor 70 which drives the application roller 50 (see FIG. 1), the pump 132 (see FIG. 5), the air connection valve 114, a three way valve 122 and drive circuits 80, 82, 84, 86 and 88 corresponding to these respective elements; and the control unit 60 sends control signals to the respective drive circuits 80 to 86 in accordance with programs, and thereby controls the operation of the respective elements.

Figure 6:
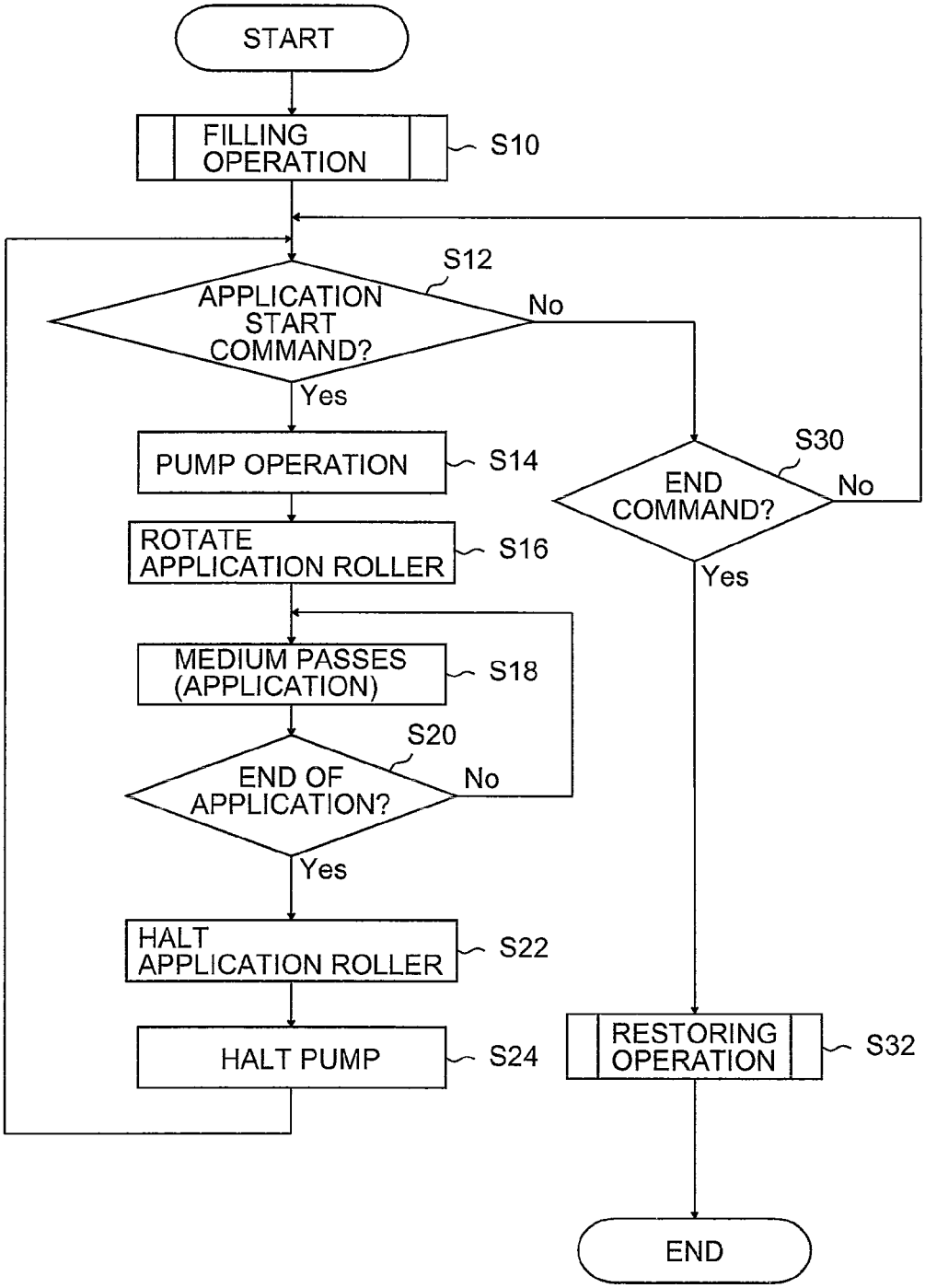
FIG. 6 is a flowchart illustrating the operational sequence of a liquid application apparatus.

FIG. 6 is a flowchart illustrating the operational sequence of the inkjet recording apparatus 10. These operations are executed in accordance with programs, under the control of the control unit 60 illustrated in FIG. 5. In the initial state at the start of this sequence, it is supposed that the liquid holding space S and the flow channels 120 and 130 are not filled with the treatment liquid.

Firstly, when the power supply of the liquid application apparatus is switched on, the filling operation (supply operation) for filling the treatment liquid into the liquid holding space S is carried out (step S10).

Figure 7:
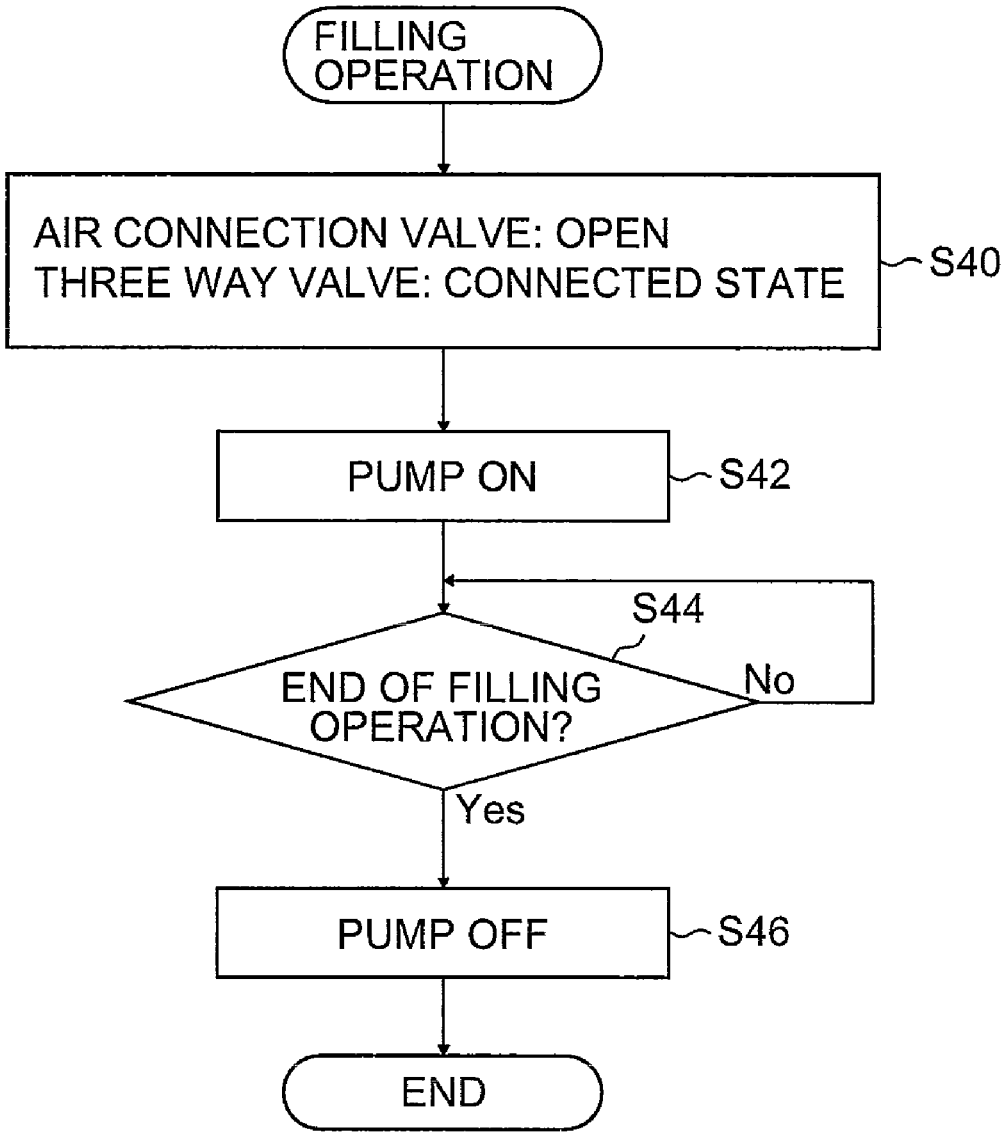
FIG. 7 is a flowchart illustrating the details of a filling operation.

Here, the filling operation is described in detail with reference to FIG. 7. FIG. 7 is a flowchart illustrating details of the filing operation. In this filling operation, firstly, the air connection valve 114 of the storage tank 110 is opened, and the three way valve 122 is switched to set the supply flow channel 120 to a connected state (a state where the storage tank side flow channel 120*a* and the liquid holding member side flow channel 120*b* are connected), and furthermore the air vent valve 134 is set to an open state (step S40). Thereupon, the driving of the pump 132 is started (switched on) (step S42). By this means, the air present in the liquid holding space S and the flow channels 120 and 130 is supplied to the storage tank 110 and the treatment liquid is filled into the respective sections.

Next, the end timing of the filling operation is judged (step S44). The judgment at step S44 is No until the end timing of the filling operation, and the driving of the pump 132 is continued. When the end timing of the filling operation is reached, the judgment in step S44 becomes Yes, and the driving of the pump 132 is halted (switched off) (step S46).

In this way, the treatment liquid is filled into the liquid holding space S and the flow channels 120 and 130, and a state is assumed whereby the treatment liquid can be supplied to the application roller 50 which is in contact with the liquid holding space S.

At step S44 illustrated in FIG. 7, the end timing of the filling operation is set as the timing at which all of the air present in the liquid holding space S and the flow channels 120 and 130 has been expelled. For example, a desirable mode is one in which a timer device that counts the drive time of the pump 132 is provided, and the end timing of the filling operation is judged on the basis of time management using the timer device.

Desirably, the time until all of the air in the respective sections is expelled is calculated or determined in advance experimentally on the basis of the volume of the liquid holding space S and the flow channels 120 and 130, and the capacity of the pump 132, and the timing of the end of this time period is set as the end timing of the filling operation described above.

After the filling operation has been carried out in this way, the presence or absence of an application start command is judged (step S12 in FIG. 6). An application start command signal is issued in coordination with the conveyance of the recording medium 12. The application start command signal is issued at a prescribed time differential in such a manner that the application of treatment liquid starts at the timing that the recording medium 12 arrives at the nip section between the application roller 50 and the counter roller 52.

When the application start command is input and a Yes verdict is obtained at step S12, then the pump 132 is operated (step S14), and furthermore the roller driving is started to rotate the application roller 50 in the clockwise direction in FIG. 1 (step S16).

By this means, the treatment liquid held in the liquid holding space S is impelled by the pressing force of the abutting member 56 of the liquid holding member 54 against the application roller 50, and thereby a layer of treatment liquid is formed on the outer circumferential surface of the application roller 50. The treatment liquid which has adhered to the outer circumferential surface of the application roller 50 is supplied to the abutting section with the counter roller 52 due to the rotation of the application roller 50.

Thereupon, the recording medium 12 is conveyed between the application roller 50 and the counter roller 52 by the medium conveyance mechanism, the recording medium 12 is introduced between the rollers 50 and 52, and furthermore the recording medium 12 is conveyed toward the paper output unit due to the rotation of the application roller 50 and the counter roller 52. The treatment liquid which has been applied to the outer circumferential surface of the application roller 50 is transferred to the recording medium 12 during this conveyance process (step S18).

Figure 8:
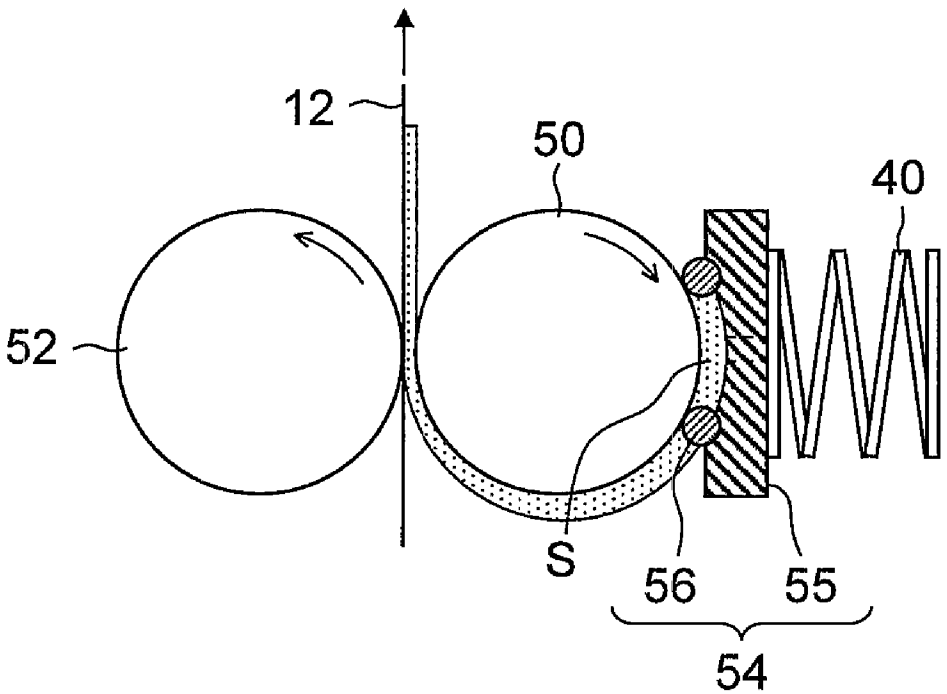
FIG. 8 is an illustrative diagram illustrating an aspect of a treatment liquid application step.

FIG. 8 illustrates an aspect of the application step in step S18. The thickness of the treatment liquid layer in FIG. 8 is depicted in an exaggerated fashion to be much larger than its actual size ratio. As illustrated in FIG. 8, the recording medium 12 which is sandwiched between the application roller 50 and the counter roller 52 is conveyed in the direction of the arrow in FIG. 8 due to the rotational force of the application roller 50, and furthermore the treatment liquid supplied to the outer circumferential surface of the application roller 50 is applied to the recording medium 12. In this way, treatment liquid of a uniform volume has been deposited onto the recording surface of the recording medium 12 which has passed between the application roller 50 and the counter roller 52.

In order to improve the transfer characteristics of the treatment liquid from the application roller 50 to the recording medium 12, it is desirable that the surface free energy of the application roller 50 should be lower than the surface free energy of the recording medium 12. In other words, a material which satisfies the inequality relationship indicated in Formula (1) below is employed as the surface member of the application roller 50.

$$\text{Surface free energy of application roller 50} < \text{Surface free energy of recording medium} \qquad \text{Formula (1)}$$

When the application operation onto the recording medium 12 described above has been carried out, the control unit 60 judges the end timing of the application operation (step S20 in FIG. 6). If liquid is applied to the whole surface of the recording medium 12, then the judgment at step S20 produces a No verdict and returns to step S18, until the recording medium 12 has passed completely.

If it is judged that the application step in the required application range has been completed (Yes verdict at step S20), for instance, the timing of the passage of the trailing edge of the recording medium 12 is detected or the end of a job of a specified number of sheets is detected, then the application roller 50 is halted (step S22), the pump 132 is halted (step S24) and the procedure returns to step S12.

The surface of the counter roller 52 has high lyophobic properties, by means of a fluorine coating for example, and is composed in such a manner that treatment liquid does not become attached readily to the surface of the counter roller 52 due to contact between the application roller 50 and the counter roller 52. By suitably designing the relationship of the free surface energy between the surface members of the both rollers, it is possible to prevent treatment liquid from becoming attached to the counter roller 52. Furthermore, a desirable mode is one in which a movement mechanism which is capable of altering the relative distance between the application roller 50 and the counter roller 52 is provided in at least one of the application roller 50 and the counter roller 52, and if it is judged that the application operation has been completed at step S20, then the adherence of treatment liquid to the surface of the counter roller 52 is prevented by setting the rollers to a mutually separated state.

At step S12, if a new application start command is input, then the processing in step S14 to step S24 described above is repeated. On the other hand, if at step S12 the application start command has not been input, then the procedure advances to step S30, and it is judged whether or not there is an application end command (step S30). The end command may be issued in accordance with various modes, such as a mode where an end command is issued automatically when a specified wait time has elapsed on the basis of time management using a timer, or the like, a mode where an end command is issued when application onto a specified number of sheets of media has been completed, a mode based on an operation from the input operating unit 64, or a mode based on a switching off operation of the apparatus power supply, or the like.

If an end command has not been input, then the procedure returns to step S12. If an end command has been input at step S30, then the return operation (restoring operation) of returning (restoring) the treatment liquid inside the liquid holding space S is carried out (step S32).

Figure 9:
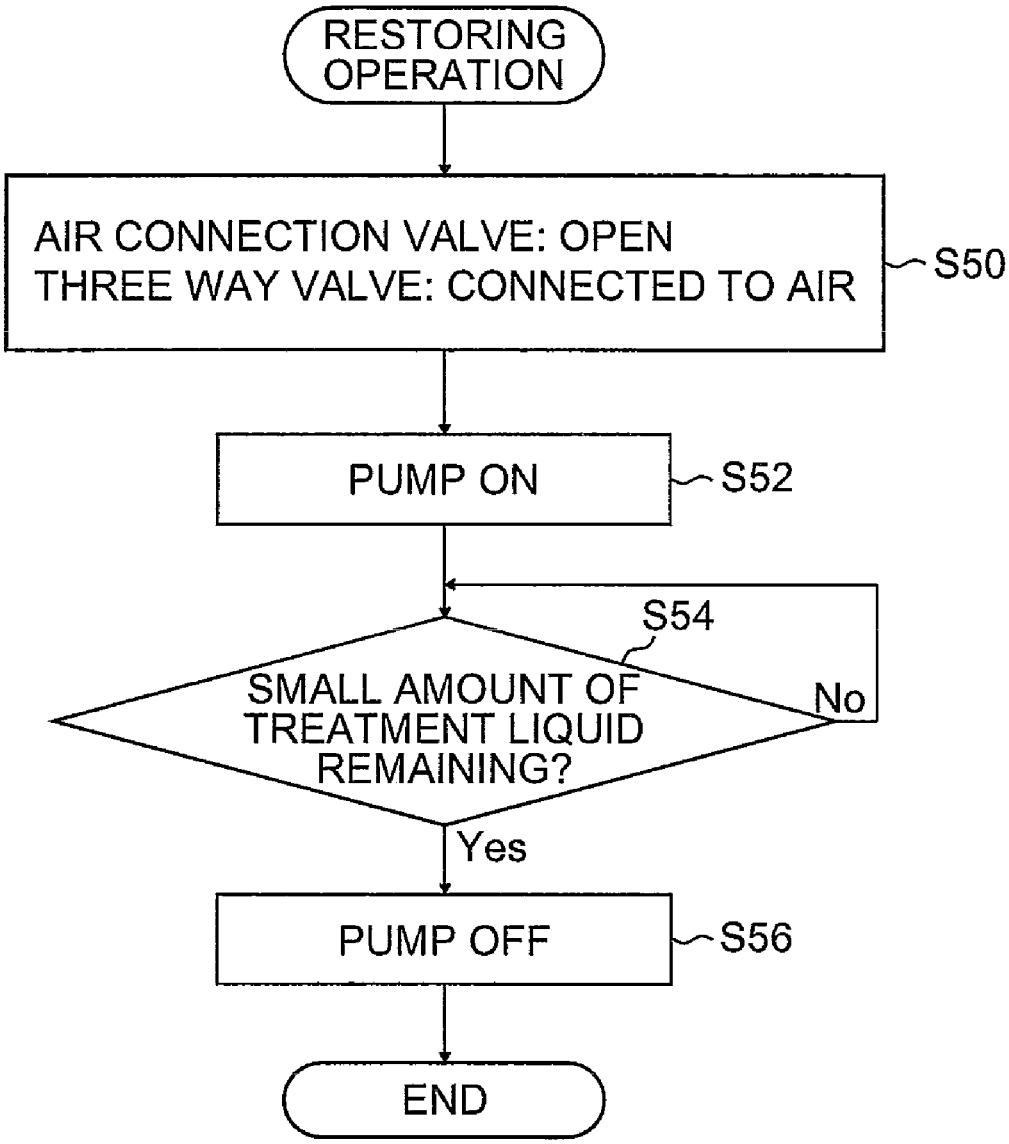
FIG. 9 is a flowchart illustrating the details of a return operation (restoring operation)

Here, the return operation (restoring operation) is described in detail with reference to FIG. 9. FIG. 9 is a flowchart illustrating the details of a return operation. In this return operation, firstly, the air connection valve 114 of the storage tank 110 is opened, and the three way valve 122 is switched to set the supply flow channel 120 to an air connected state (a state where the liquid holding member side flow channel 120*b* and the air connection port 124 are connected) (step S50). Thereupon, the driving of the pump 132 is started (switched on) (step S52). By this means, the treatment liquid in the liquid holding space S is sent to the storage tank 110, and the air taken in via the air connection port 124 is filled into the respective sections.

Next, the end timing of the return operation is judged (step S54). The judgment at step S54 is No until the end timing of the return operation, and the driving of the pump 132 is continued. When the end timing of the filling operation is reached, the judgment in step S44 becomes Yes, and the driving of the pump 132 is halted (switched off) (step S56).

Here, the end timing of the return operation uses a timing slightly before the return of all of the treatment liquid present in the path from the liquid holding member side flow channel 120*b* of the supply flow channel 120 including the liquid holding space S to the return flow channel 130 (hereinafter, this path is called "liquid path A").

In this way, the treatment liquid inside the liquid path A is returned into the storage tank 110 and the liquid path A becomes filled with air.

In the present embodiment, a desirable mode is one in which a timer device that counts the drive time of the pump 132 is provided, and the end timing of the return operation is judged on the basis of time management using the timer device.

After the return operation, the air connection valve 114 is closed, the three way valve 122 is switched so as to set the liquid holding member side flow channel 120*b* and the air connection port 124 to a connected state, and the storage tank 110 is shut off from the air, thereby preventing evaporation and outflow of liquid.

First Embodiment

In the present embodiment, when entering the end command at step S30 in FIG. 6, prior to stopping the inkjet recording apparatus 10, the pump 132 is repeatedly rotated forward and backward, so that the interface (gas-liquid interface L1) between the air and the treatment liquid in the supply channel 120 and the recovery channel 130 is oscillated. The treatment liquid near the wall surfaces of the supply channel 120 and the recovery channel 130, or contacting the wall surfaces is thereby agitated, and the high viscosity paste-like viscous substance and solidified substance produced by evaporation of the solvent component in the treatment liquid is re-dissolved into the treatment solution. Further, instead of rotating the pump 132 forward and backward, the supply channel 120 and the recovery channel 130 may be oscillated.

Figure 10:
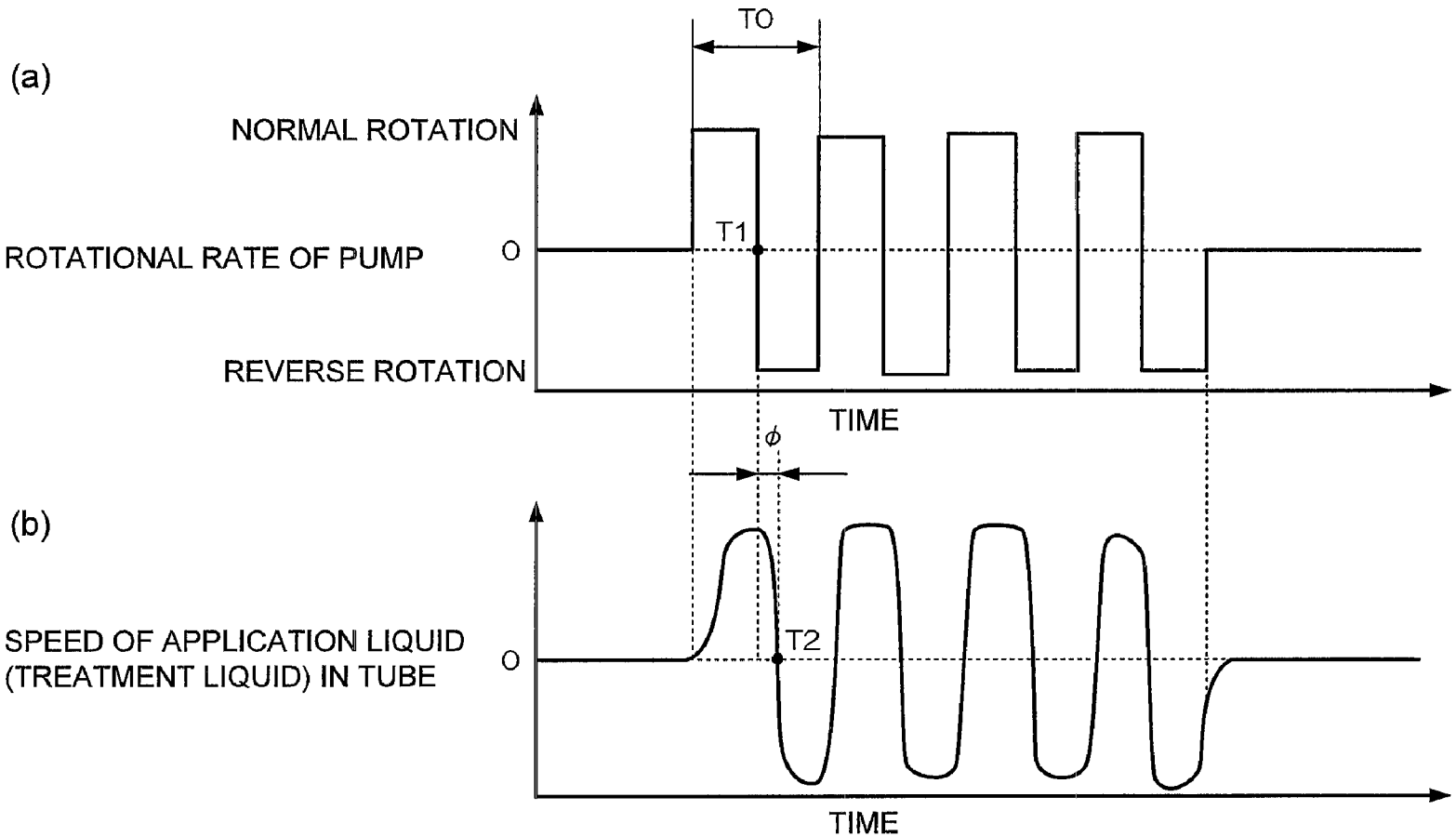
FIG. 10 illustrates graphs in items (a) and (b) for relationship between the rotational rate of a pump and the movement rate of an application liquid in a flow channel.

(a) and (b) parts of FIG. 10 illustrate graphs indicating the relationship between the rotational rate of the pump and the movement rate of the application liquid in the flow channels. Further, as explained below, when the pump 132 rotates forward, the movement rate of the treatment liquid is positive, and the treatment liquid moves through the recovery channel 130 in the direction to be recovered into the storage tank 110; and when the pump 132 rotates backward, the movement rate of the treatment liquid is negative, and the treatment liquid moves from the storage tank 110 in the direction to be returned to the channel 130.

As indicated in (a) and (b) parts of FIG. 10, when cyclically repeating rotating the pump 132 forward and backward, the application liquid in the flow channels (supply channel 120 and recovery channel 130) oscillates. Here, making the repeated cycles of rotating the pump 132 forward and backward as short as possible is desirable. Specifically, it is desirable to control the pump 132 such that the pump 132 rotates backward while the treatment solution is moving forward (while the velocity is positive), and the pump 132 rotates forward while the treatment solution is moving backward (while the velocity is negative). Concretely, the pump 132 is controlled such that there is a short time interval when switching the forward rotation of the pump 132 to backward rotation and the backward rotation to forward rotation (such that the slope of the curve when the sign of the pump 132 velocity in (a) part of FIG. 10 changes precipitously (roughly perpendicularly)). By controlling the pump 132 as described above, as indicated in (b) part of FIG. 10, a phase difference $\phi$ ($=\{(T2-T1)/T0\times360\}°>0$; here, T0 is the forward/backward rotation cycle of pump 132) is produced between the time T1, at which the rotational velocity of the pump 132 becomes zero, and the time T2, at which the velocity of the treatment liquid becomes zero, and turbulent flows are produced in the channels 120 and 130, and flow perpendicular to the wall surfaces of the channels 120 and 130 is produced. The viscous substance and solidified substance can thereby be effectively incorporated into the treatment solution.

Second Embodiment

Next, a second embodiment of the present invention will be described. In addition, descriptions of the same configurations as in the first embodiment above will be omitted.

The present embodiment is one that repeatedly rotates the pump 132 forward and backward when recovering the treatment liquid to the storage tank 110 (step S32 in FIG. 6).

Figure 11:
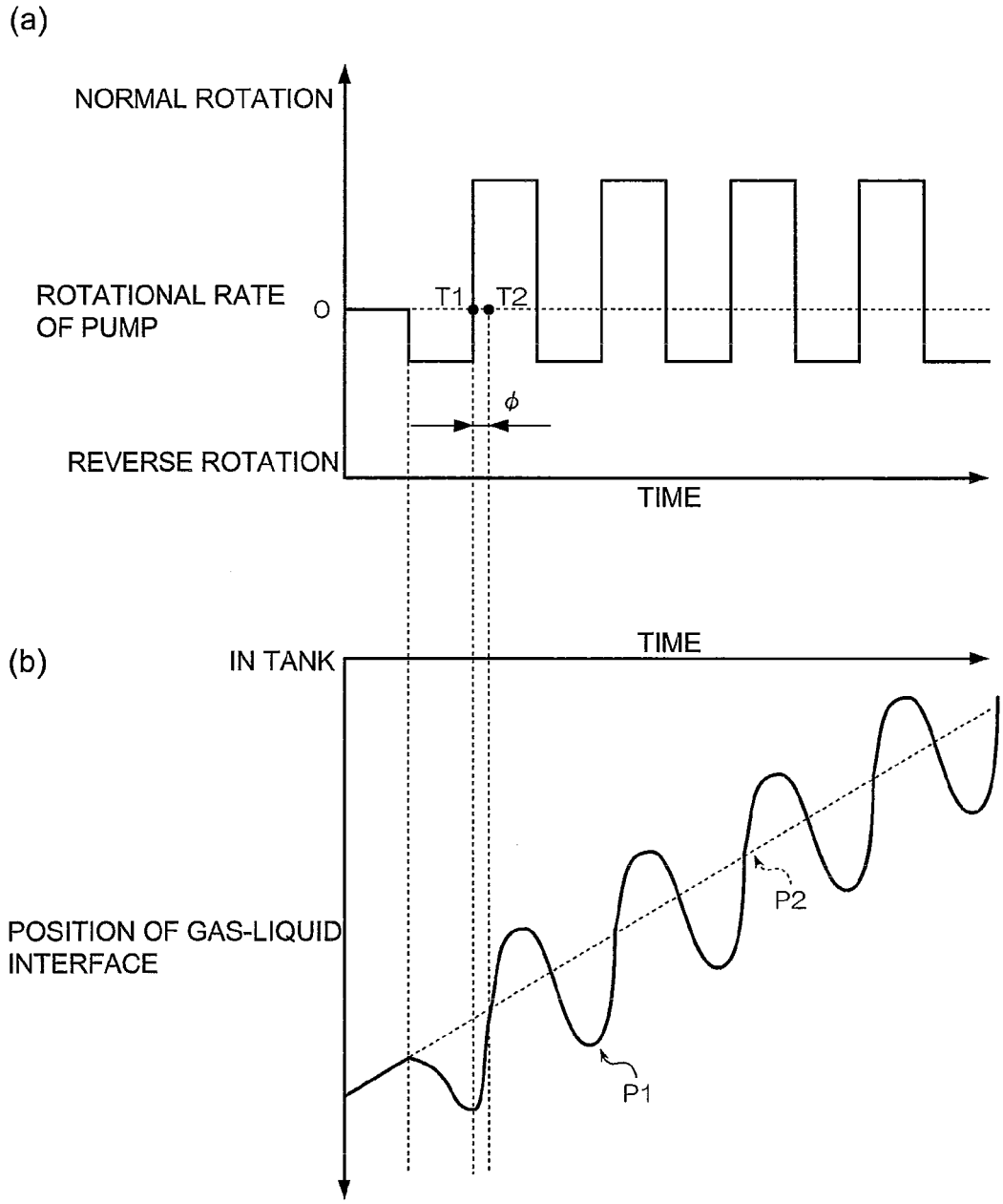
FIG. 11 illustrates graphs in items (a) and (b) for relationship between the rotational rate of the pump and the position of gas-liquid interface L1 in a flow channel.

(a) and (b) parts of FIG. 11 illustrate graphs indicating the relationship between the rotational rate of the pump and the position of gas-liquid interface L1 in the flow channel In (b) part of FIG. 11, the curve P1 indicates the position of the gas-liquid interface L1, and the slope of the dotted line of curve P2 indicates the average movement rate of the gas-liquid interface L1.

As indicated in (a) and (b) parts of FIG. 11, when recovering the treatment liquid into the storage tank 110, the treatment liquid inside the flow channels 120 and 130 is recovered into the storage tank 110 while oscillating the gas-liquid interface L1 by repeatedly rotating the pump 132 forward and backward. The viscous substance and solidified substance adhering to the wall surfaces of the flow channels 120 and 130 can thereby be re-dissolved or the particles of viscous substance and solidified substance can be distributed and incorporated into the treatment solution and recovered into the storage tank 110.

Further, in the example indicated in (a) and (b) parts of FIG. 11, the absolute value of the rotational rate during forward rotation of the pump 132 is made greater than the absolute value of the rotational rate during backward rotation, and this may be accomplished, for example, by making the time of forward rotation of the pump 132 greater than the time of backward rotation.

Moreover, it is also possible to conduct the repeated forward and backward rotation of the pump 132 as described above, for example, during the filling operation (step S10 in FIG. 6). In this case, the absolute value of the rotational rate of the pump 132 during forward rotation may be made smaller than the absolute value of the rotational rate during the backward rotation, or the time of forward rotation of the pump 132 may be made shorter than the time of the backward rotation.

In the present embodiment as well, as in the first embodiment above, making the repeated cycles of rotating the pump 132 forward and backward as short as possible is desirable. Specifically, it is desirable to control the pump 132 such that the pump 132 rotates backward while the treatment solution is moving forward (while the velocity is positive), and the pump 132 rotates forward while the treatment solution is moving backward (while the velocity is negative). A phase difference $\phi$ ($=\{(T2-T1)/T0\times360\}^{\circ}>0$; here, T0 is the forward/backward rotation cycle of pump 132) is thereby produced between the time T1, at which the rotational velocity of the pump 132 becomes zero, and the time T2, at which the velocity of the treatment liquid becomes zero (where curves P1 and P2 cross in (b) part of FIG. 11), and turbulent flows are produced in the channels 120 and 130, and flow perpendicular to the wall surfaces of the channels 120 and 130 is produced, and the viscous substance and solidified substance can be more effectively incorporated into the treatment solution.

EXAMPLES

TABLE 1

| Examples | Oscillation | Phase difference | Gas-liquid interface average movement rate (rate of treatment liquid returning to storage tank | Degradation level of liquid circulation rate in liquid holding member (equivalent to it after use for three years) | Application unevenness (equivalent to it after use for three years) |
|---|---|---|---|---|---|
| 1 | Created | 0° | 0 cm/s | Δ | Δ |
| 2 | Created | 20° | 0 cm/s | ○ | ○ |
| 3 | Created | 40° | 0 cm/s | ○ | ○ |
| 4 | Created | 40° | 1 cm/s | ○○ | ○○ |
| 5 | Created | 40° | 3 cm/s | ○○ | ○○ |
| 6 | Created | 40° | 10 cm/s | Δ | Δ |
| Comparative Example | Not Created | — | 3 cm/s | x | x |

Illustrated in Table 1 are the changes of the treatment liquid application performance when varying the phase difference $\phi$ between the rotational rate of the pump 132 and the movement rate of the treatment liquid, and when varying the average movement rate of the gas-liquid interface L1 (slope of the dotted line P2 in (b) part of FIG. 11).

In the examples 1 to 6 and the comparative example in Table 1, the previously described treatment liquid B was used as the treatment liquid, and assessment tests of treatment solution application performance (circulation rate and application unevenness of the treatment liquid in the liquid holding member (application cap) 54) after 3 years had elapsed were conducted by setting the inkjet recording apparatus 10 use frequency, time used for application, and time of storing the treatment solution in the flow channels 120 and 130 or in the storage tank 110 respectively to A4 paper 500 sheets/day, 5 seconds/sheet, and 1 month/lot (specifically, replacement with new liquid was conducted every month (replacement of the storage tank 110)).

Further, the meaning of the symbols in Table 1 is as follows.

(1) "Degradation level of liquid circulation rate in liquid holding member 54 (application cap)"

"○○": 5% or less;

"○": 10% or less;

"Δ": 20% or less; and

"x": 30% or less.

(2) Application unevenness

"○○": no unevenness at all when drawing a 50% grid in black ink;

"○": no visual unevenness when drawing a 50% grid in black ink;

"Δ": minor visual unevenness when drawing a 50% grid in black ink; and

"x": visual unevenness when drawing a 50% grid in black ink.

As indicated in Table 1, concerning the treatment liquid application performance after 3 years of use, examples 1 to 6 which repeatedly rotated (oscillated) the pump 132 forward and backward were superior to the comparative example which did not conduct oscillations.

Moreover, in examples 1 to 3 which had a gas-liquid interface average movement rate of zero (corresponding to the first embodiment), concerning the treatment liquid application performance after 3 years of use, examples 2 and 3 which did not have a phase difference ϕ of zero were superior to example 1 which had a phase difference ϕ of zero.

In addition, in examples 4 to 6 which recovered the treatment liquid into the storage tank 110 while conducting oscillations (corresponding to embodiment 2), concerning the treatment liquid application performance after 3 years of use, examples 4 and 5 which had small gas-liquid interface average movement rates was superior to example 6 which had a large gas-liquid interface average movement rate (10 cm/s).

As indicated above, according to embodiments of the present invention, degradation of treatment liquid application performance can be prevented by maintaining a phase difference between the cycle of forward and backward rotations of the pump 132 and the movement rate of the treatment liquid when conducting oscillations of the treatment liquid. Further, according to embodiments of the present invention, when the treatment liquid is recovered to the storage tank 110 while conducting oscillations of the treatment liquid, degradation of treatment liquid application performance can be prevented by making a small gas-liquid interface average movement rate (for example, less than 10 cm/s), and by lengthening the treatment liquid recovery time.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid application apparatus comprising:

an application member that has an application surface applying a liquid onto a medium;

a holding member that abuts against the application surface of the application member so as to form a liquid holding space in which the liquid is held;

a liquid application device that rotates the application surface of the application member in such a manner that the liquid supplied from the holding member to the application surface is applied onto the medium;

a storage device that stores the liquid;

a first flow channel and a second flow channel that connect the storage device to the holding member;

a liquid movement device that supplies the liquid from the storage device to the holding member via the first flow channel and the second flow channel and recovers the liquid from the holding member to the storage device via the first flow channel and the second flow channel, the liquid movement device that causes oscillation of the liquid in the first flow channel, the second flow channel and a flow channel including the liquid holding space to generate a flow of the liquid; and a controller that controls the liquid movement device to generate the flow of the liquid caused by the oscillation in such a manner that a product which is generated from the liquid, has a higher viscosity than the liquid and adheres to interior walls of the first flow channel and the second flow channel, is dissolved in the liquid or collected in the liquid, wherein the controller controls the liquid movement device in such a manner that a phase difference is provided between a phase of the oscillation caused by the liquid movement device and a phase of the flow of the liquid in the first flow channel and the second flow channel.

2. The liquid application apparatus as defined in claim 1, wherein the controller controls the liquid movement device in such a manner that the oscillation of the liquid is caused when the liquid application apparatus is turned off.

3. The liquid application apparatus as defined in claim 1, wherein the controller controls the liquid movement device to generate the flow of the liquid in the first flow channel, the second flow channel and a flow channel including the liquid holding space in such a manner that the flow channels oscillate when the liquid is restored into the storage device due to the flow.

4. A liquid application apparatus comprising:

an application member that has an application surface applying a liquid onto a medium;

a holding member that abuts against the application surface of the application member so as to form a liquid holding space in which the liquid is held;

a liquid application device that rotates the application surface of the application member in such a manner that the liquid supplied from the holding member to the application surface is applied onto the medium;

a storage device that stores the liquid;

a first flow channel and a second flow channel that connect the storage device to the holding member;

a liquid movement device that supplies the liquid from the storage device to the holding member via the first flow channel and the second flow channel and recovers the liquid from the holding member to the storage device via the first flow channel and the second flow channel, the liquid movement device that causes oscillation of the liquid in the first flow channel, the second flow channel and a flow channel including the liquid holding space to generate a flow of the liquid; and a controller that controls the liquid movement device to generate the flow of the liquid caused by the oscillation in such a manner that a product which is generated from the liquid, has a higher viscosity than the liquid and adheres to interior walls of the first flow channel and the second flow channel, is dissolved in the liquid or collected in the liquid, wherein:

the liquid movement device performs a forward driving such that force is applied to the liquid so as to send the liquid from the storage device to the holding member, and a backward driving such that force is applied to the liquid so as to send the liquid from the holding member to the storage device, and the controller controls the liquid movement device to generate the flow of the liquid caused by the oscillation in such a manner that when the liquid movement device is switched from the forward driving to the backward driving, the liquid is moved from the storage device toward the holding member, and when the liquid movement device is switched from the backward driving to the forward driving, the liquid is moved from the holding member toward the storage device.

5. The liquid application apparatus as defined in claim 4, wherein the controller controls the liquid movement device in such a manner that the force applied to the liquid during the forward driving is larger than the force applied to the liquid during the backward driving.

6. The liquid application apparatus as defined in claim 4, wherein the controller controls the liquid movement device in such a manner that time of applying the force to the liquid during the forward driving is longer than time of applying the force to the liquid during the backward driving.

7. The liquid application apparatus as defined in claim 1, wherein the controller controls the liquid movement device in such a manner that the oscillation of the liquid is caused when the liquid is sent to the holding member from the storage device so as to fill the liquid holding space with the liquid.

8. An inkjet recording apparatus comprising:

the liquid application apparatus defined in claim 1;

a recording head that ejects an ink; and a recording device that causes the recording head to eject the ink onto a medium to which the liquid application apparatus has applied the liquid.

9. The liquid application apparatus as defined in claim 4, wherein the controller controls the liquid movement device in such a manner that the oscillation of the liquid is caused when the liquid application apparatus is turned off.

10. The liquid application apparatus as defined in claim 4, wherein the controller controls the liquid movement device to generate the flow of the liquid in the first flow channel, the second flow channel and a flow channel including the liquid holding space in such a manner that the flow channels oscillate when the liquid is restored into the storage device due to the flow.

11. The liquid application apparatus as defined in claim 4, wherein the controller controls the liquid movement device in such a manner that the oscillation of the liquid is caused when the liquid is sent to the holding member from the storage device so as to fill the liquid holding space with the liquid.

12. An inkjet recording apparatus comprising:

the liquid application apparatus defined in claim 4;

a recording head that ejects an ink; and a recording device that causes the recording head to eject the ink onto a medium to which the liquid application apparatus has applied the liquid.

13. A liquid storage method of a liquid application apparatus having an application member that has an application surface applying a liquid onto a medium, a holding member that abuts against the application surface of the application member so as to form a liquid holding space in which the liquid is held, a liquid application device that rotates the application surface of the application member in such a manner that the liquid supplied from the holding member to the application surface is applied onto the medium, a storage device that stores the liquid, and a first flow channel and a second flow channel that connect the storage device to the holding member, the liquid storage method comprising:

a liquid movement step of causing oscillation of the liquid in the first flow channel, the second flow channel and a flow channel including the liquid holding space to generate a flow of the liquid by a liquid movement device that supplies the liquid from the storage device to the holding member via the first flow channel and the second flow channel and recovers the liquid from the holding member to the storage device via the first flow channel and the second flow channel; and a recovery step of generating the flow of the liquid caused by the oscillation in such a manner that a product which is generated from the liquid, has a higher viscosity than the liquid and adheres to interior walls of the first flow channel and the second flow channel, is dissolved in the liquid or collected in the liquid, wherein, in the recovery step, a phase difference is provided between a phase of the oscillation caused by the liquid movement device and a phase of the flow of the liquid in the first flow channel and the second flow channel.

14. The liquid storage method as defined in claim 13, wherein the oscillation of the liquid is caused when the liquid application apparatus is turned off.

15. The liquid storage method as defined in claim 13, wherein, in the recovery step, the flow of the liquid in the first flow channel, the second flow channel and a flow channel including the liquid holding space is generated in such a manner that the flow channels oscillate when the liquid is restored into the storage device due to the flow.

16. The liquid storage method as defined in claim 13, wherein the oscillation of the liquid is caused when the liquid is sent to the holding member from the storage device so as to fill the liquid holding space with the liquid.

17. A liquid storage method of a liquid application apparatus having an application member that has an application surface applying a liquid onto a medium, a holding member that abuts against the application surface of the application member so as to for a liquid holding space in which the liquid is held, a liquid application device that rotates the application surface of the application member in such a manner that the liquid supplied from the holding member to the application surface is applied onto the medium, a storage device that stores the liquid, and a first flow channel and a second flow channel that connect the storage device to the holding member, the liquid storage method comprising:

a liquid movement step of causing oscillation of the liquid in the first flow channel, the second flow channel and a flow channel including the liquid holding space to generate a flow of the liquid by a liquid movement device that supplies the liquid from the storage device to the holding member via the first flow channel and the second flow channel and recovers the liquid from the holding member to the storage device via the first flow channel and the second flow channel; and a recovery step of generating the flow of the liquid caused by the oscillation in such a manner that a product which is generated from the liquid, has a higher viscosity than the liquid and adheres to interior walls of the first flow channel and the second flow channel, is dissolved in the liquid or collected in the liquid, wherein:

the liquid movement step includes a forward driving step of applying force to the liquid so as to send the liquid from the storage device to the holding member, and a backward driving step of applying force to the liquid so as to send the liquid from the holding member to the storage device, and in the recovery step, the flow of the liquid caused by the oscillation is generated in such a manner that when a driving step is switched from the forward driving step to the backward driving step, the liquid is moved from the storage device toward the holding member, and when the driving step is switched from the backward driving step to the forward driving step, the liquid is moved from the holding member toward the storage device.

18. The liquid storage method as defined in claim 17, wherein the force applied to the liquid during the forward driving step is larger than the force applied to the liquid during the backward driving step.

19. The liquid storage method as defined in claim 17, time of applying the force to the liquid during the forward driving step is longer than time of applying the force to the liquid during the backward driving step.

20. The liquid storage method as defined in claim 17, wherein the oscillation of the liquid is caused when the liquid application apparatus is turned off.

21. The liquid storage method as defined in claim 17, wherein, in the recovery step, the flow of the liquid in the first flow channel, the second flow channel and a flow channel including the liquid holding space is generated in such a manner that the flow channels oscillate when the liquid is restored into the storage device due to the flow.

22. The liquid storage method as defined in claim 17, wherein the oscillation of the liquid is caused when the liquid is sent to the holding member from the storage device so as to fill the liquid holding space with the liquid.

* * * * *